US012378026B2

(12) United States Patent
Yaguchi

(10) Patent No.: US 12,378,026 B2
(45) Date of Patent: Aug. 5, 2025

(54) CREASING TOOL AND GIFT WRAPPING METHOD USING SAID CREASING TOOL

(71) Applicant: Taro Yaguchi, Tokyo (JP)

(72) Inventor: Taro Yaguchi, Tokyo (JP)

( * ) Notice: Subject to any disclaimer, the term of this patent is extended or adjusted under 35 U.S.C. 154(b) by 71 days.

(21) Appl. No.: 17/754,822

(22) PCT Filed: Oct. 14, 2020

(86) PCT No.: PCT/JP2020/038816
§ 371 (c)(1),
(2) Date: May 1, 2023

(87) PCT Pub. No.: WO2021/075472
PCT Pub. Date: Apr. 22, 2021

(65) Prior Publication Data

US 2024/0101294 A1 Mar. 28, 2024

(30) Foreign Application Priority Data

Oct. 16, 2019 (JP) ..... 2019-189667

(51) Int. Cl.
*B65B 49/02* (2006.01)
*B65B 49/00* (2006.01)
(Continued)

(52) U.S. Cl.
CPC ..... *B65B 49/00* (2013.01); *B65B 67/10* (2013.01)

(58) Field of Classification Search
CPC ..... B65B 11/004; B65B 11/02; B65B 45/00; B65B 49/00; B65B 49/02; B65B 49/08;
(Continued)

(56) References Cited

U.S. PATENT DOCUMENTS 755,462 A * 3/1904 Deiser ..... B65B 25/18 53/219
956,994 A * 5/1910 Peck ..... B65B 11/02 53/218

(Continued)

FOREIGN PATENT DOCUMENTS

JP 2006-44720 A 2/2006
JP 2018-39220 A 3/2018
JP 2019-34783 A 3/2019

OTHER PUBLICATIONS

English Translation of The International Search Report.
English Translation of Written Opinion of the International Searching Authority.

*Primary Examiner* — Thanh K Truong
*Assistant Examiner* — Patrick B Fry
(74) *Attorney, Agent, or Firm* — Taro Yaguchi

(57) ABSTRACT

The present invention is a creasing tool, comprising: a thin plate main body (9); a first hinge (10) provided over the full length of the main body (9) in a first direction; a second hinge (11) that is provided over the full length of the main body (9) in a second direction and crosses the first hinge (10); and a third hinge that extends in one direction from an intersection (12) of the first hinge and the second hinge toward the outside of the main body (9) along a bisection line of the angle formed by the first hinge (10) and the second hinge (11), wherein when producing gift wrapping, a crease required for oblique wrapping or the like can be easily created in packaging paper.

7 Claims, 26 Drawing Sheets

(51) Int. Cl.
*B65B 49/08* (2006.01)
*B65B 67/08* (2006.01)
*B65B 67/10* (2006.01)

(58) Field of Classification Search
CPC ..... B65B 67/08; B65H 45/12; B65H 45/14; B65H 45/30; B65H 2301/45
USPC ..... 53/461, 219, 390; 493/405, 356, 451, 493/457, 397, 458
See application file for complete search history.

(56) References Cited

U.S. PATENT DOCUMENTS 1,162,611 A * 11/1915 Jones ..... B26D 7/27 53/514
1,907,693 A * 5/1933 Wichner ..... B65B 25/20 53/206
2,925,758 A * 2/1960 Beetz ..... B31B 50/44 493/171
3,103,243 A * 9/1963 Senior ..... B21D 51/2646 72/332
4,400,929 A * 8/1983 Iwaki ..... B65B 23/20 72/306
4,421,500 A * 12/1983 Smith ..... B43M 3/02 493/405
4,865,579 A * 9/1989 Kirby ..... B65H 45/04 493/405
8,387,346 B1 3/2013 Coates
2018/0072448 A1 3/2018 Hama et al.

* cited by examiner

CREASING TOOL AND GIFT WRAPPING METHOD USING SAID CREASING TOOL

FIELD OF THE INVENTION

The present invention relates to a creasing tool and a gift-wrapping method using the same; and a knot-tying tool and a knot-tying method using the same.

BACKGROUND OF THE INVENTION

Conventionally, a common way to wrap a gift is to use packaging paper.

In that case, a box containing the gift is first placed on the packaging paper, which is then bent so that it covers the sides of the box; and after all the box sides are covered, the packaging paper is affixed by applying a piece of adhesive tape or the like to prevent unwrapping.

Here, common box-wrapping methods include the "caramel wrapping" and the "diagonal wrapping."

In the caramel wrapping method, a box is placed on and at the center of packaging paper with each of the box sides being parallel to the respective side of the packaging paper, and then, right and left parts of the packaging paper are affixed on the upper surface of the box, and finally, the front and back parts of the packaging paper cover the front and back sides of the box to close the wrapping.

Whereas, in the diagonal wrapping, a box is placed on and at an angle with packaging paper, and the box is rolled together with the packaging paper to wrap the box. This wrapping method has advantages in that it is faster and uses less adhesive tape compared to the caramel wrapping.

PRIOR ART DOCUMENT

Patent Document

Non-Patent Document

SUMMARY OF THE INVENTION

Problem to be Solved by the Invention

Incidentally, the diagonal wrapping has one drawback that it is difficult to determine the size of packaging paper since a box is not placed parallel to the packaging paper. Also, it is difficult to appropriately determine an initial position as well as an angle of the box relative to a size of the wrapping paper. Moreover, in the case of the diagonal wrapping, double-layered pleats must be made while folding the packaging paper, making it difficult to master this technique.

Furthermore, after wrapping with the packaging paper, it is sometimes preferred to tie a ribbon around the wrapped box either in place of or in addition to affixing the packaging paper with the adhesive tape. However, tying a ribbon knot also takes a technique which is difficult to master.

Considering the above situation, the purpose of the present invention is to provide a tool and a method for enabling effective wrapping with packaging paper in the diagonal wrapping.

Also, similarly, another purpose of the present invention is to provide a tool and a method for enabling effective knot-tying with a ribbon, string, or the like.

Means for Solving the Problem

In order to achieve the above object, according to a principal aspect of the present invention, the following invention is provided.

(1) A creasing tool, comprising:
- a thin plate-like main body;
- a first hinge provided over a full length of the main body in a first direction;
- a second hinge provided over a full length of the main body in a second direction and crosses the first hinge; and
- a third hinge that extends in one direction from an intersection of the first hinge and the second hinge toward the outside of the main body along a bisection line of an angle formed by the first hinge and the second hinge, wherein the creasing tool is configured to crease the packaging paper by having a user insert a part of the main body opposite from a part provided with the third hinge, under an object placed on packaging paper to thereby sandwich the packaging paper between the object and the inserted part of the main body; adjust the position of the intersection to coincide with the position of one of the object's corners; and subsequently, fold parts of the main body located outside of the object in a valley fold along the first and second hinges, and in a mountain fold along the third hinge.

(2) The creasing tool of the above (1), wherein
an angle between the first hinge and the second hinge is 90 degrees.

(3) The creasing tool of the above (2), wherein
the creasing tool is for diagonal wrapping, and
a reference line is drawn on the main body for positioning the main body relative to an edge (rim) of the packaging paper.

(4) The creasing tool of the above (3), wherein
the reference line is drawn at an angle of about 33 degrees from the first hinge or the second hinge.

(5) A method for wrapping an object using a creasing tool, the creasing tool comprising:
- a thin plate-like main body;
- a first hinge provided over a full length of the main body in a first direction;
- a second hinge provided over a full length of the main body in a second direction and crosses the first hinge; and
- a third hinge that extends in one direction from an intersection of the first hinge and the second hinge toward the outside of the main body along a bisection line of an angle formed by the first hinge and the second hinge, the method comprising the steps of:

inserting a part of the main body opposite from a part provided with the third hinge, under an object placed on packaging paper to thereby sandwich the packaging paper between the object and the inserted part of the main body, and adjusting the position of the intersection to coincide with the position of one of the object's corners; and folding parts of the main body located outside of the object in a valley fold along the first and second hinges, and in a mountain fold along the third hinge to thereby crease the packaging paper.

(6) The method of the above (5), wherein
an angle between the first hinge and the second hinge is 90 degrees.

(7) The method of the above (5), wherein
the creasing tool is for diagonal wrapping, and a reference line is drawn on the main body for positioning the main body relative to an edge (rim) of the packaging paper, the method further comprising the step of:

positioning the reference line of the main body relative to an edge (rim) of the packaging paper, and positioning the intersection and the hinges relative to corners and sides of the object.

(8) A knot-tying tool for placing a string for wrapping around an object, and forming a knot having at least two loops, comprising:

a main body which may be hand-held by a user;

an intersection pressing section formed in one end of the main body for pinching an intersection of the ribbon wrapped around the object between the object and this intersection pressing section;

a first loop forming section provided in the opposing end from the intersection pressing section of the main body for hooking and folding one of two intersecting ribbon end parts extending from the first intersection; and a second loop forming section provided between the intersection pressing section and the first loop forming section, for passing the other ribbon end part, extending from the above intersection, through under a first loop and reverse to form a second loop.

(9) The knot-tying tool of the above (8), wherein the second loop forming section is provided between the intersection pressing section and the first loop forming section, and comprises a slit for passing the ribbon therethrough after it was folded back from the first loop forming section 27; and a space section 30 for enabling the user's finger, grasping the second loop, to insert therein.

(10) The knot-tying tool of the above (8), further comprising:

a folding slit for folding the string at a 45-degree angle.

(11) The knot-tying tool of the above (8), wherein there are arrows and numbers printed on one side or both sides of the knot-tying tool for indicating procedures to form a knot with a string.

Note that characteristics other than those described above are disclosed in the following description on an embodiment and accompanying drawings.

EFFECT OF THE INVENTION

DETAILED DESCRIPTION OF THE INVENTION

One embodiment of the present invention will be described below in accordance with accompanying drawings.

1. Wrapping Tool Kit

Figure 1:
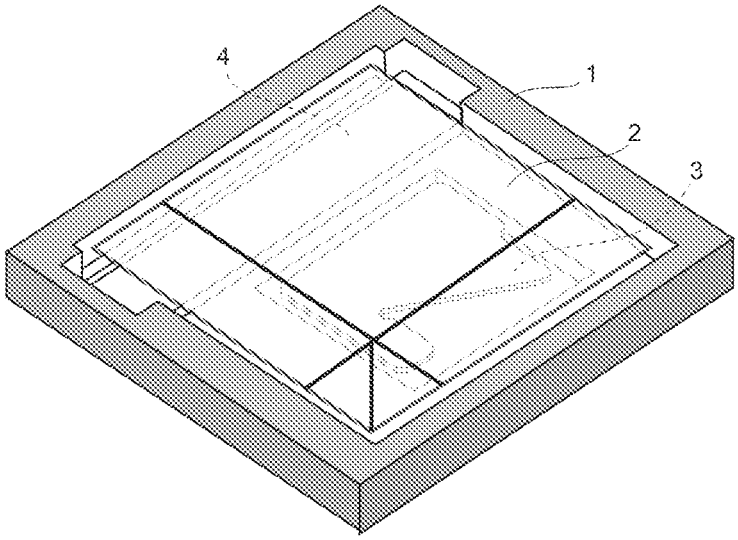
FIG. 1 is a perspective view showing a wrapping kit according to one embodiment of the present invention.
Figure 2:
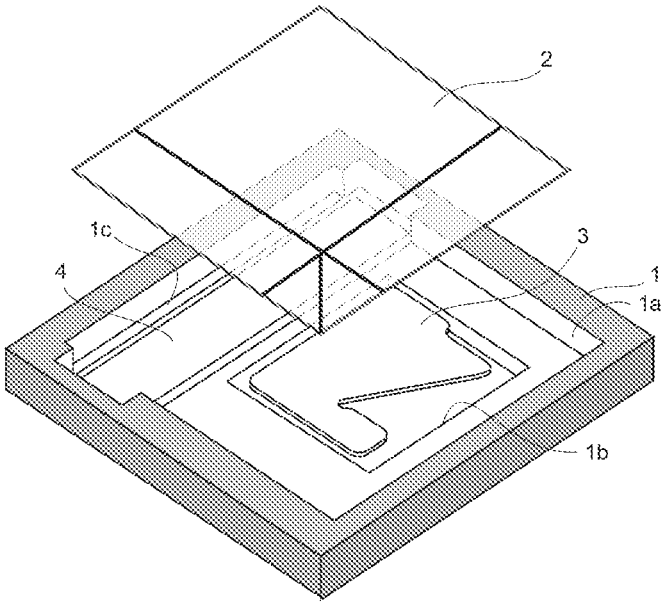
FIG. 2 is a perspective view of the wrapping kit according to the one embodiment.

FIG. 1 and FIG. 2 respectively show a wrapping tool kit according to the present embodiment.

This kit houses and is defined by a case 1, a creasing tool 2 housed in the case 1, a ribbon tying tool 3, and a cutting ruler 4, which are wrapping tools used for wrapping an object of wrapping such as a present, a product, or the like.

In this case 1, recesses 1*a*-1*c* are formed in optimal shapes in predetermined positions, respectively, for housing each of the tools 2-5 in such a way that these tools may be encased in a well-organized manner by inserting the tools 2-4 in the recesses 1*a*-1*c*, respectively.

This case 1 has a transparent lid, which is not shown, so that closing the case 1 with the lid will prevent the respective tools 2-4 from falling off the case 1.

2. Creasing Tool

Figure 3:
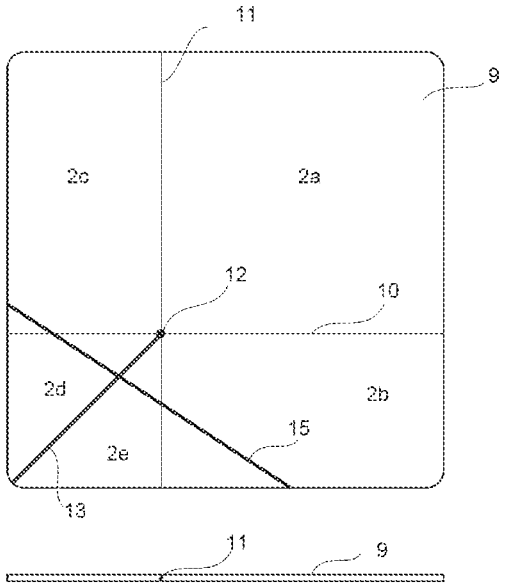
FIG. 3 are a plan view and a side view, respectively, of a creasing tool according to the one embodiment.

As shown in FIG. 3, the creasing tool 2 has a generally rectangular thin plate main body 9; a first hinge 10 provided over the full width of the thin plate main body 9 in a first direction; a second hinge 11 that is provided over the full width of the thin plate main body 9 in a second direction and crosses the first hinge 10; and a third hinge 13 that extends in one direction from the intersection 12 of the first hinge 10 and the second hinge 11 toward the outside of the main body along a bisection line of the angle formed by the first hinge 10 and the second hinge 11.

The thin plate main body 9 is formed of, for example, a translucent plastic material such as polypropylene or the like. The above first to third hinges 10, 11, 13 are respectively formed by reducing the plate thickness in parts along them by pressing, cutting, or laser milling on both or one of the sides of this thin plate main body 9.

These first to third hinges 10, 11, 13 divide the thin plate main body 9 into first to fifth panels 1-5 shown as 2*a*-2*e* in the figure. Among these panels, the first panel indicated with 2*a* (which is located in point symmetry relative to the above third hinge 13 about the intersection 12 of the first and second hinges 10, 11) is used in such a way that it is inserted under packaging paper (wrapping paper) with an object of wrapping (e.g., a box) placed on the packaging paper, as described further below.

Therefore, the thickness of the thin plate main body 9 is preferably 1.5 mm or less, more preferably 1 mm, 0.7 mm, 0.5 mm or less so that the thin plate main body 9 may be inserted under the packaging paper smoothly. Also, corners of this thin plate main body 9 are preferably chamfered or rounded.

Further, a reference line 15 is drawn on this thin plate main body 9 for positioning the creasing tool 2 against an edge of the packaging paper. The way to use this reference line 15 will be described in the next usage section.

3. Functions of the Creasing Tool

Figure 4:
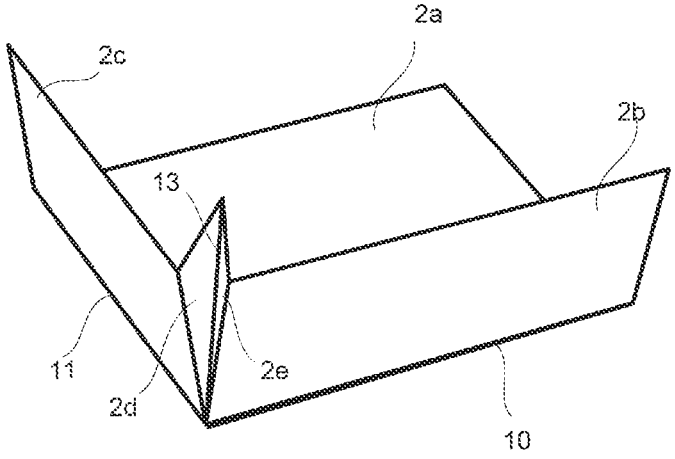
FIG. 4 is a perspective view showing a form of the creasing tool in use according to the one embodiment.

As shown in FIG. 4, it is contemplated that the panels indicated as the second and third panels 2*b*, 2*c* are used in such a way that they stand up by being folded upward in a "valley fold" along the sides of the wrapping object with the first panel 2*a* as a reference. As these second and third panels 2*b*, 2*c* are raised upright, the third hinge section is folded in a "mountain fold" with the intersection 12 of the first and second hinges as a fulcrum and with the other end points being raised; and the triangular fourth and fifth panels 2*d*, 2*e*, sandwiching the third hinge 13, are folded to overlap each other.

By performing the above actions with the packaging paper and the object being placed on the first panel 2*a*, the packaging paper is sandwiched and folded between the object and the second-fifth panels 2*b*-2*e*, and creased along the first to third hinges 10, 11, 13.

3. How to Use the Creasing Tool

Figure 5:
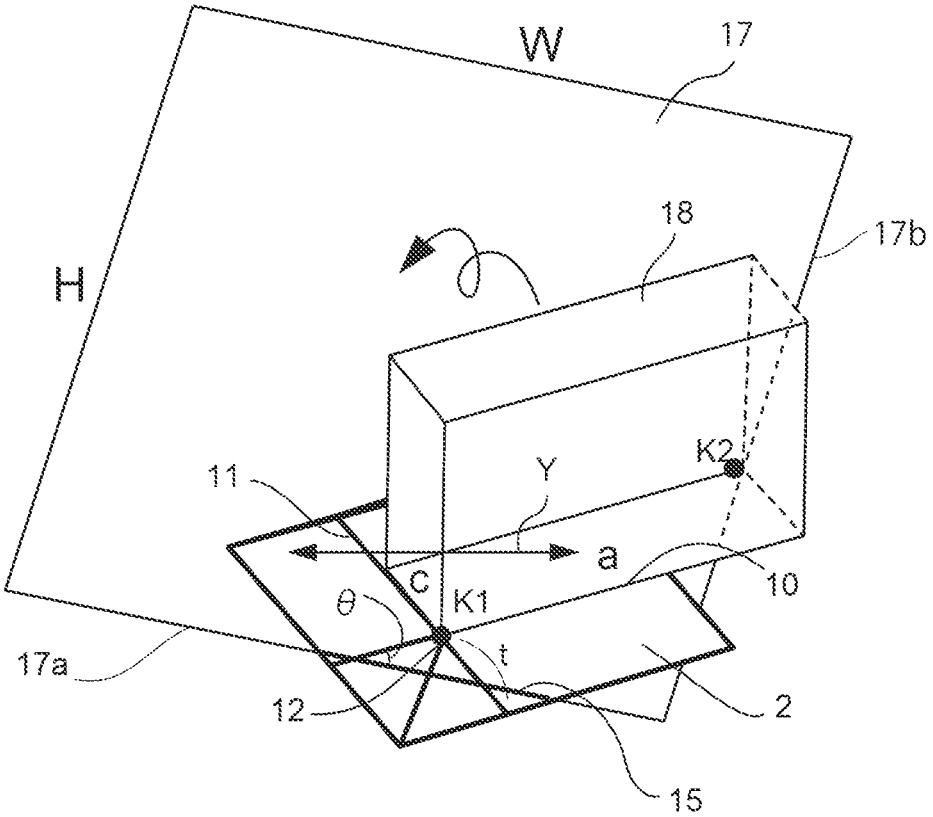
FIG. 5 is a schematic view showing positional relationship among packaging paper, an object, and the creasing tool according to the one embodiment.

As shown in FIG. 5, the present embodiment will be described in a following case, where a box-shaped object 18 is placed on a piece of packaging paper 17 cut into a rectangular shape of an appropriate size (width W, height H), and the object will be rolled and wrapped at an angle (by diagonal wrapping) from the front to back, as indicated with an arrow.

(1) Setting the Packaging Paper Size

Figure 6:
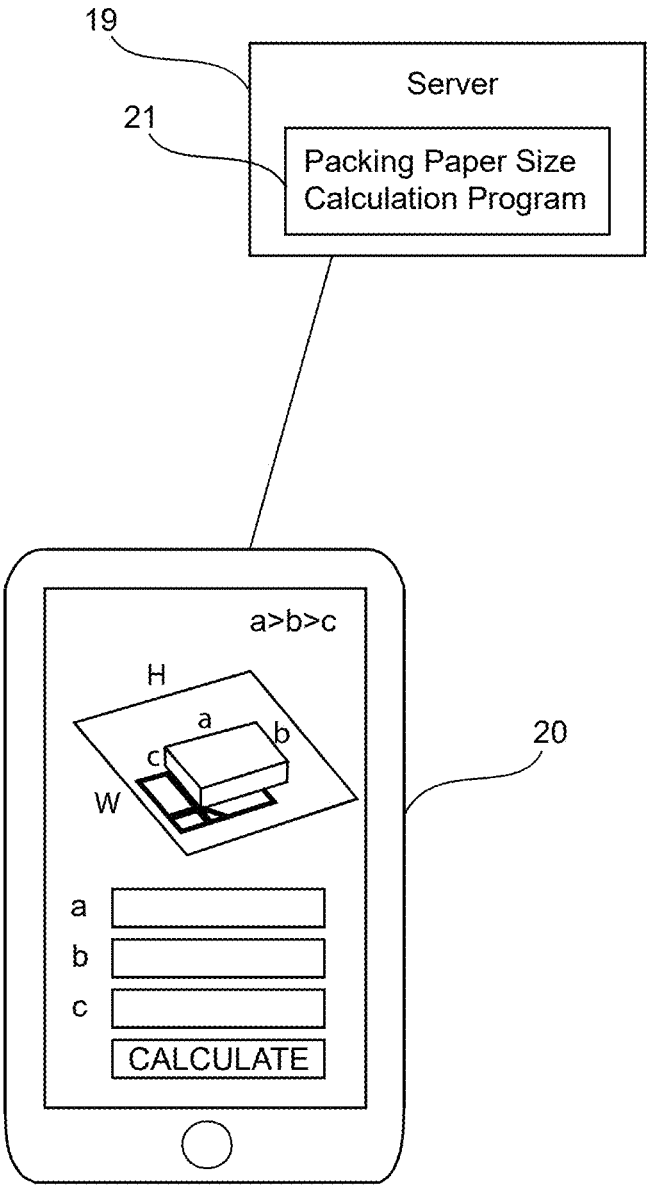
FIG. 6 is a schematic view showing a server and a user interface according to the one embodiment.

Here, the size of the packaging paper 17 is preferably obtained by calculation, and when the object 18 is a hexahedron, for example, the packaging paper size is calculated from three parameters: lengths of the longest side a, the second longest side b, and the shortest side c of the object; and in this embodiment, as shown in FIG. 6, a packaging paper size calculation program 21 installed in a server 19 is configured to perform this calculation and provide a user interface 20 on a display of a smartphone or the like.

In this embodiment, the packaging paper size calculation program 21 is configured to determine the packaging paper size H, W according to an angle è of the reference line provided on the creasing tool 2, and a distance t between the reference line 15 and the intersection 12.

Accordingly, this packaging paper size calculation program 21 performs a calculation using a creasing tool type; the angle è of the reference line 15 and the distance t according to that type; length a-c of the object 18; and a required margin d (not shown), outputs the packaging paper dimensions H, W, and displays them to a user.

Also, options for the creasing tool are preferably displayed for selection since the type of the creasing tool 2 is used for the above calculation. Moreover, options for the packaging paper 17 are preferably provided as well since the margin varies depending on the paper used as the packaging paper.

Further, when the object 18 is a cube, in other words, when a-c have the same value, non-regular wrapping method may be selected (i.e., the furthest position of the box will change), and therefore, the packaging paper size calculation program 21 preferably comprises a program for determining if the object is a cube or if a-c are equal or generally equal.

Also, the program 21 is preferably adapted to draw a graphic according to a selected box shape as well as output a paper size on the user interface.

Here, shaping of the packaging paper 17 may be performed by either cutting a piece of paper of the determined size out of a larger piece of paper, or folding unnecessary part or parts of a larger piece of paper.

(2) Positioning Process

First, an object 18 and packaging paper 17 are positioned using the creasing tool 2.

When the diagonal wrapping is used, as shown in FIG. 5, an initial position of the object 18 on the packaging paper 17 is important.

Then, first, the reference line 15 of the creasing tool 2 is placed on the packaging paper 17 so that the reference line 15 aligns or overlaps with a front edge 17*a* of the packaging paper 17. At this point, the reference line 15 is positioned such that, for example, the dimension to the intersection 12 indicated as tin the figure is 2.5 cm (1 inch) and that the angle è with the first hinge 10 is 33 degrees.

At the same time, the side a, the longest of the three sides constituting the object 18 is aligned along the first hinge 10, and the shortest side is aligned along the second hinge 11. At this point, a corner K1, which is the front-most corner of the object 18 among its corners contacting the packaging paper 17, should be precisely on the intersection 12 of the first and second hinges 10, 11.

Also, a corner K2, which is the rear-most corner of the object 18 among its corners contacting the packaging paper 17, is positioned so that the corner K2 will be generally on a right-side edge 17*b* of the packaging paper 17 by translating the creasing tool 2 and the object 18 along a front edge 17*a* of the packaging paper 17 (arrow Y) to adjust positions of the creasing tool 2 and the object 18 relative to the packaging paper 17.

Figure 7:
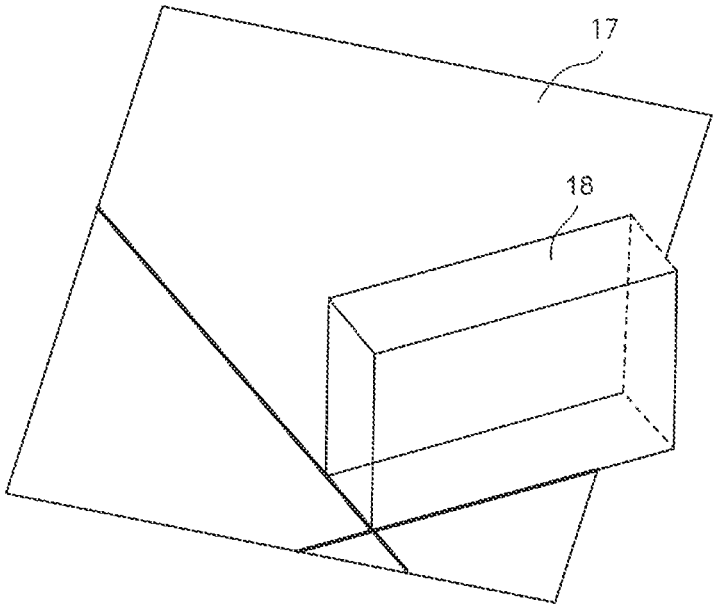
FIG. 7 is a schematic view showing a wrapping process according to the one embodiment.
Figure 8:
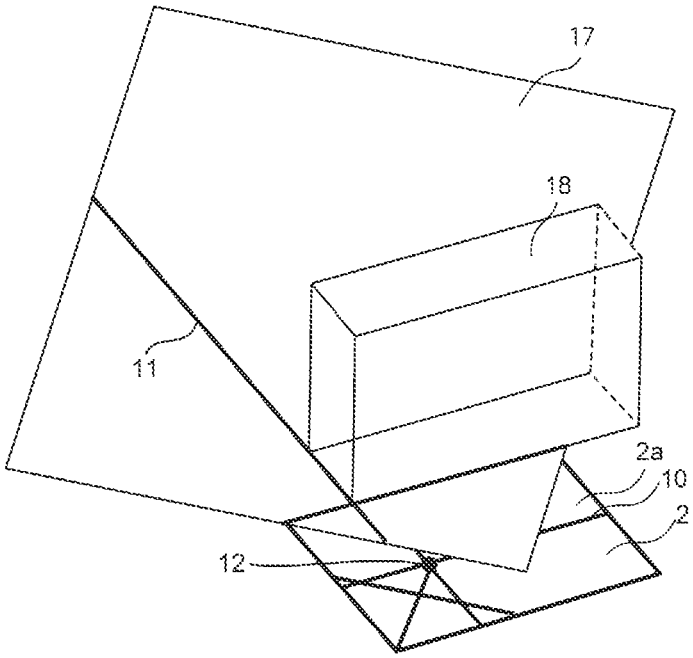
FIG. 8 is a schematic view showing the wrapping process according to the one embodiment.

Thus, when the reference line 15 is aligned on the front edge 17*a* of the packaging paper 17, and simultaneously the corners K1 and K2 of the object 18 are positioned with the creasing tool 2 and the packaging paper 17 as above, the creasing tool 2 is pulled out as shown in FIG. 7, and a creasing process is started as shown in FIG. 8 and later.

(2) First Creasing Step

First, as shown in FIG. 8, the creasing tool 2 is inserted under the packaging paper 17, and aligned such that the positions of the intersection 12 and the front-left corner K1 of the object 18 coincide.

Figure 9:
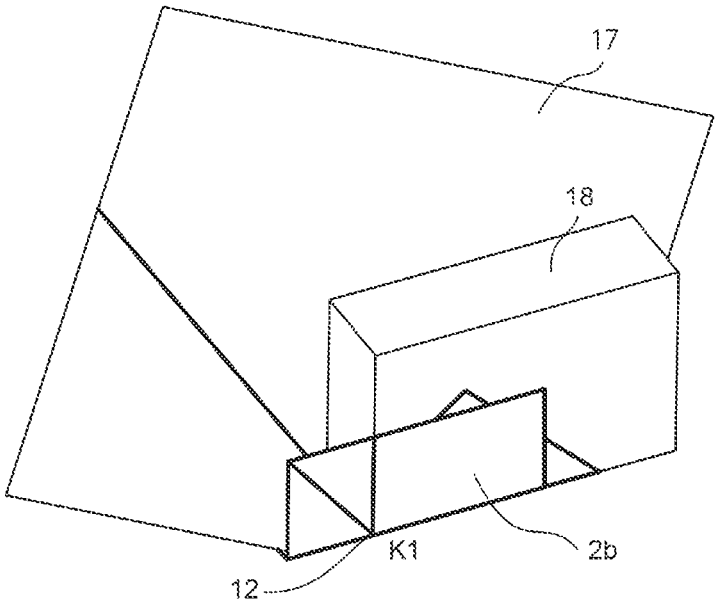
FIG. 9 is a schematic view showing the wrapping process according to the one embodiment.

Next, as shown in FIG. 9, the front second panel 2*b* of the creasing tool 2 is raised so that a right corner triangle part of the packaging paper 17 is folded upward along the first hinge 10. Then, while maintaining the position of the box relative to the packaging paper, roll over the box backwards by 90 degrees. Accordingly, one of the largest sides of the object 18 is positioned at the bottom as shown in FIG. 10.

Figure 10:
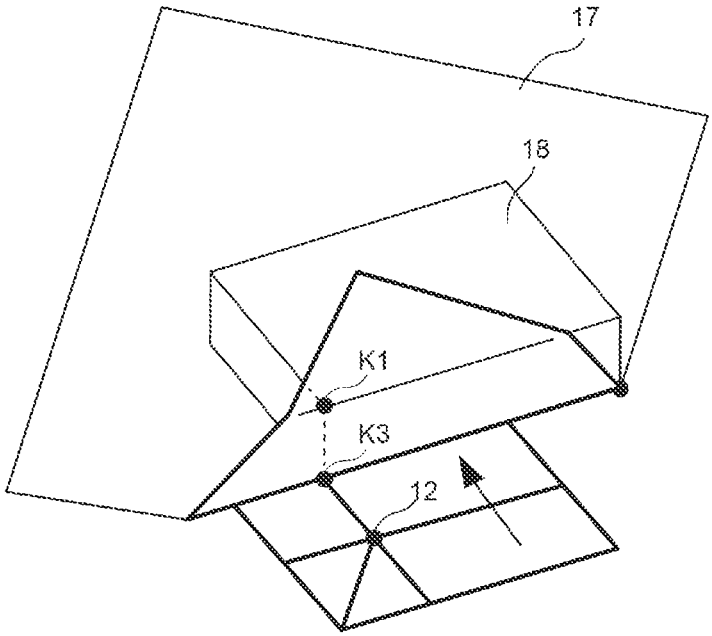
FIG. 10 is a schematic view showing the wrapping process according to the one embodiment.
Figure 11:
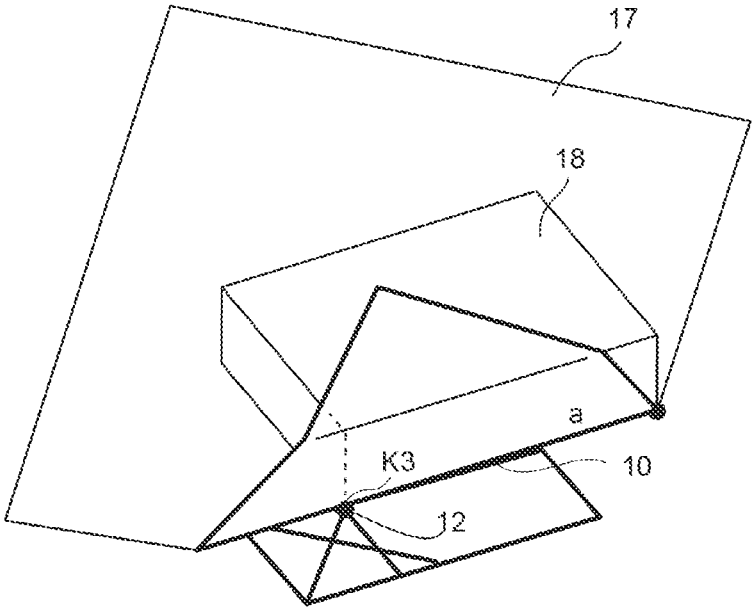
FIG. 11 is a schematic view showing the wrapping process according to the one embodiment.
Figure 12:
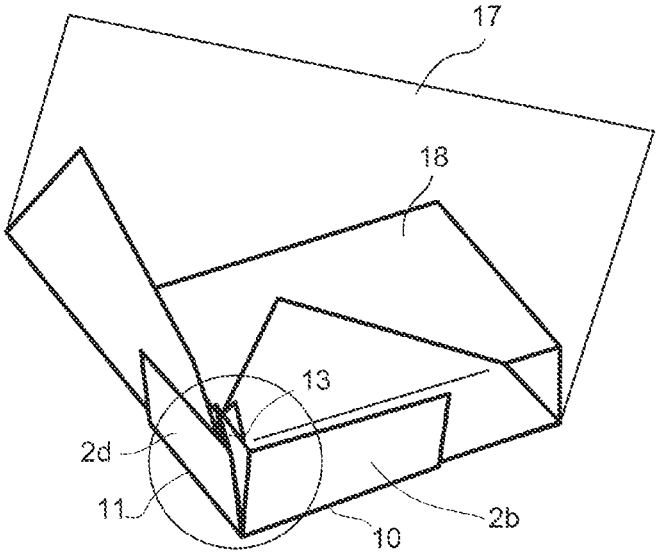
FIG. 12 is a schematic view showing the wrapping process according to the one embodiment.

At this point, as indicated with an arrow in FIG. 10, the first panel 2*a* part of the creasing tool 2 is inserted under the packaging paper so that the position of the intersection 12 coincides with a corner K3, which is now the front-left-most corner of the object's bottom surface (FIG. 11), and the first hinge section 10 is also aligned along the object's longest side a. Then, as shown in FIG. 12, the second panel 2*b* of the creasing tool 2 is folded up in a valley fold along the first hinge 10, and the second hinge 11 is folded up in a valley fold. Thus, as described above, the outer end of the third hinge 13 is raised and simultaneously folded in a mountain fold, to create a crease in the packaging paper, as shown in FIG. 12.

With the present creasing tool, the part of the packaging paper 17 which is folded inward and become invisible from outside (the part inside the circle in the figure) may be formed easily and aesthetically by folding the first to third hinge sections 10, 11, 13 at the same time to thereby forming a "step fold" while creating an "inside reverse fold."

Figure 13:
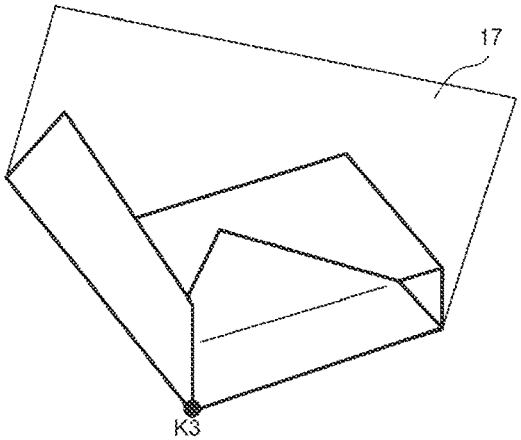
FIG. 13 is a schematic view showing the wrapping process according to the one embodiment.
Figure 14:
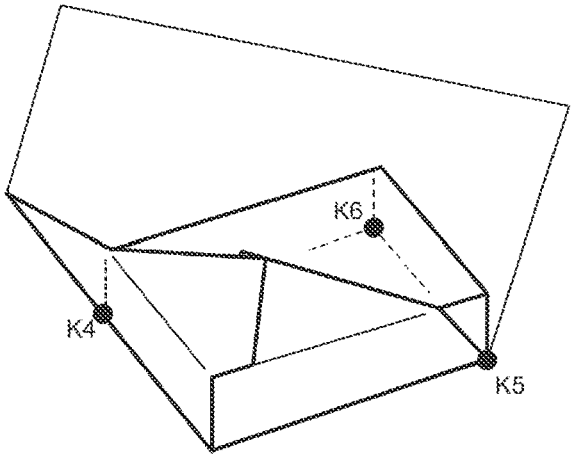
FIG. 14 is a schematic view showing the wrapping process according to the one embodiment.

Next, as shown in FIG. 13, the creasing tool 2 is removed, and after folding the packaging paper 17 along the crease made with the creasing tool 2 as above, a triangular part of the packaging paper 17 is folded over the object 18, as shown in FIG. 14.

(3) Repeating the Creasing Step for the Second Time and Later

Subsequently, creases will be made sequentially in the same manner as above for a rear-left corner K4, a right-side corner K5, and a rear-most corner K6, as shown in FIG. 14. In other words, for each corner, steps of making a crease with the creasing tool 2; removing the creasing tool 2; and rolling the box rearward while folding the packaging paper toward the box, are repeated, and finally, a piece of adhesive tape is affixed to finish wrapping.

4. Ribbon-Tying Tool

Next, a ribbon-tying tool 3 will be described in reference with FIG. 15 and later.

Figure 15:
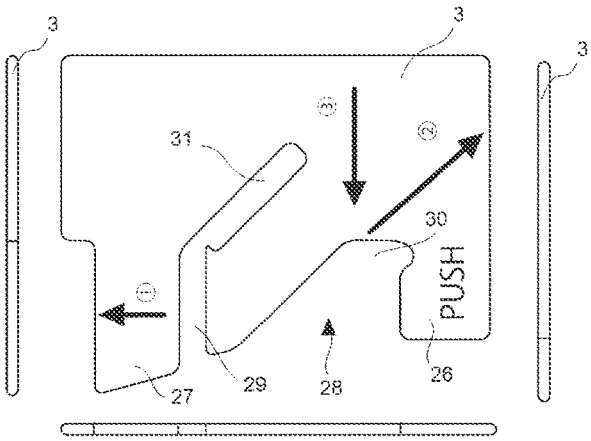
FIG. 15 is a plan view showing a ribbon knot-tying tool according to the one embodiment.

This ribbon-tying tool 3, as shown in FIG. 15, is a tool for wrapping a ribbon around an object 18 finished with paper wrapping, and forming a bowknot, comprising: a main body 25 which may be hand-held by a user; an intersection pressing section 26 formed in one end of the main body 25 for pinching the first intersection of the ribbon wrapped around the object 18 between the object and this intersection pressing section 26; a first loop forming section 27 provided in the opposing end from the intersection pressing section 26 for hooking and folding one of two intersecting ribbon end parts extending from the first intersection; and a second loop forming section 28 provided between the intersection pressing section 26 and the first loop forming section 27, for forming a second loop with the other ribbon end part extending from the above intersection, and subsequently making the second loop pass through under a first loop and reverse.

Here, the second loop forming section 28 is provided between the intersection pressing section 26 and the first loop forming section 27, and comprises a slit 29 for passing the ribbon therethrough after it was folded back from the first loop forming section 27; and a space section 30 for enabling the user's finger, grasping the second loop, to insert therein.

Also, this tying tool 3 comprises a ribbon-folding slit 31 extending the from the slit 29 at an angle of 45 degrees for folding the ribbon back.

Figure 16:
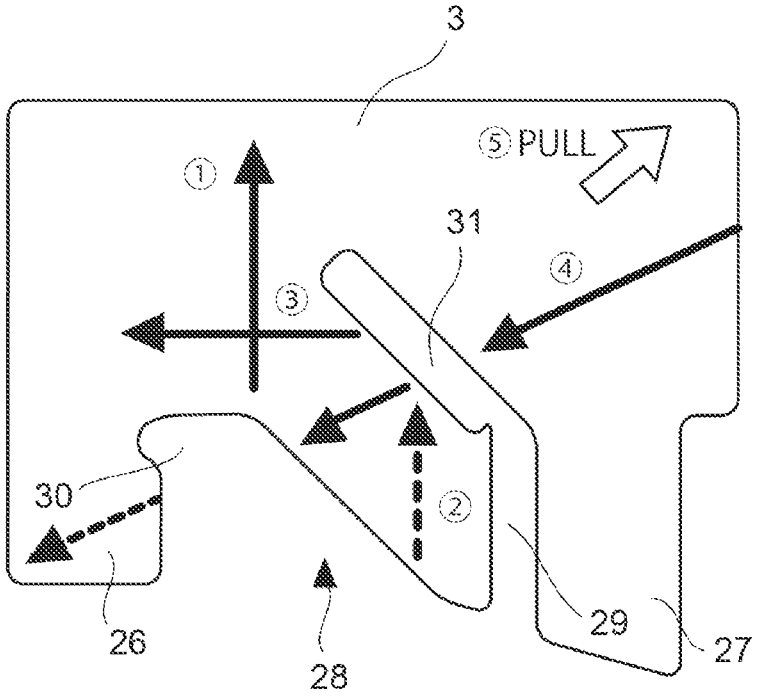
FIG. 16 is a plan view showing the ribbon knot-tying tool according to the one embodiment.

Further, there are arrows and numbers printed on this tying tool 3, as shown in FIG. 15, for indicating procedures to tie the ribbon in a bowknot on the front side. Moreover, on the back of the tying tool 3, there are arrows and numbers printed, as shown in FIG. 16, for indicating procedures to hook the ribbon crosswise to create an intersection.

5. How to Use the Ribbon-Tying Tool

In this embodiment example, a criss-cross bow will be described by way of example.

(1) Forming an Intersecting Part

Figure 17:
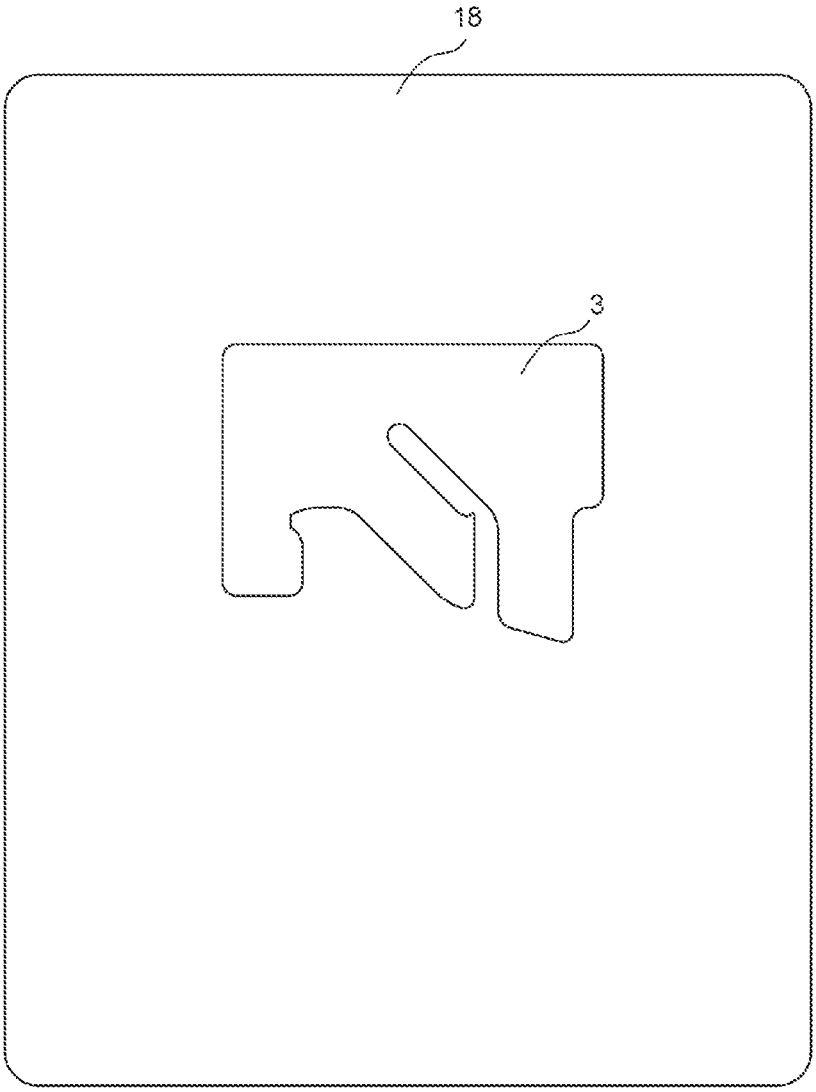
FIG. 17 is a schematic view showing a ribbon knot-tying process according to the one embodiment.

First, as shown in FIG. 17, the ribbon-tying tool 3 is placed at a desirable position to make a knot on the surface of the object 18.

Figure 18:
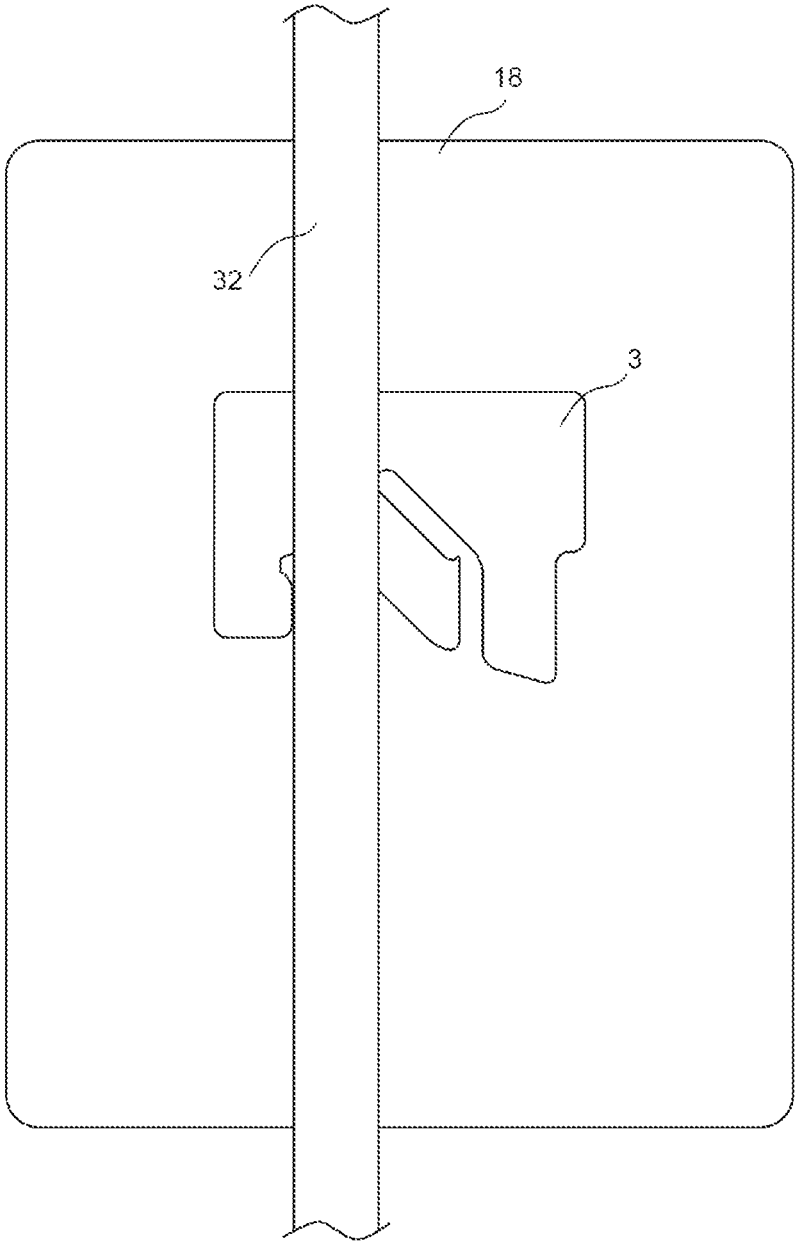
FIG. 18 is a schematic view showing the ribbon knot-tying process according to the one embodiment.
Figure 19:
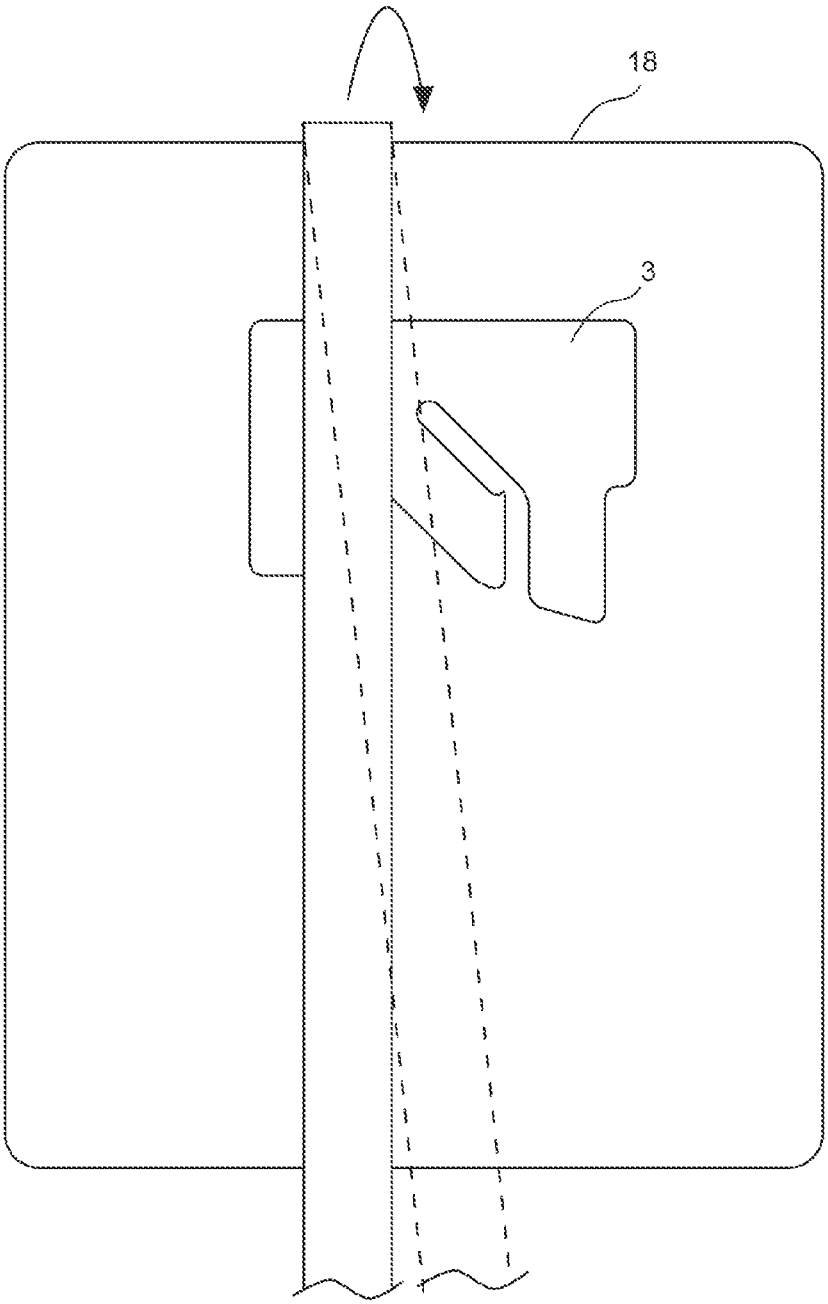
FIG. 19 is a schematic view showing the ribbon knot-tying process according to the one embodiment.
Figure 20:
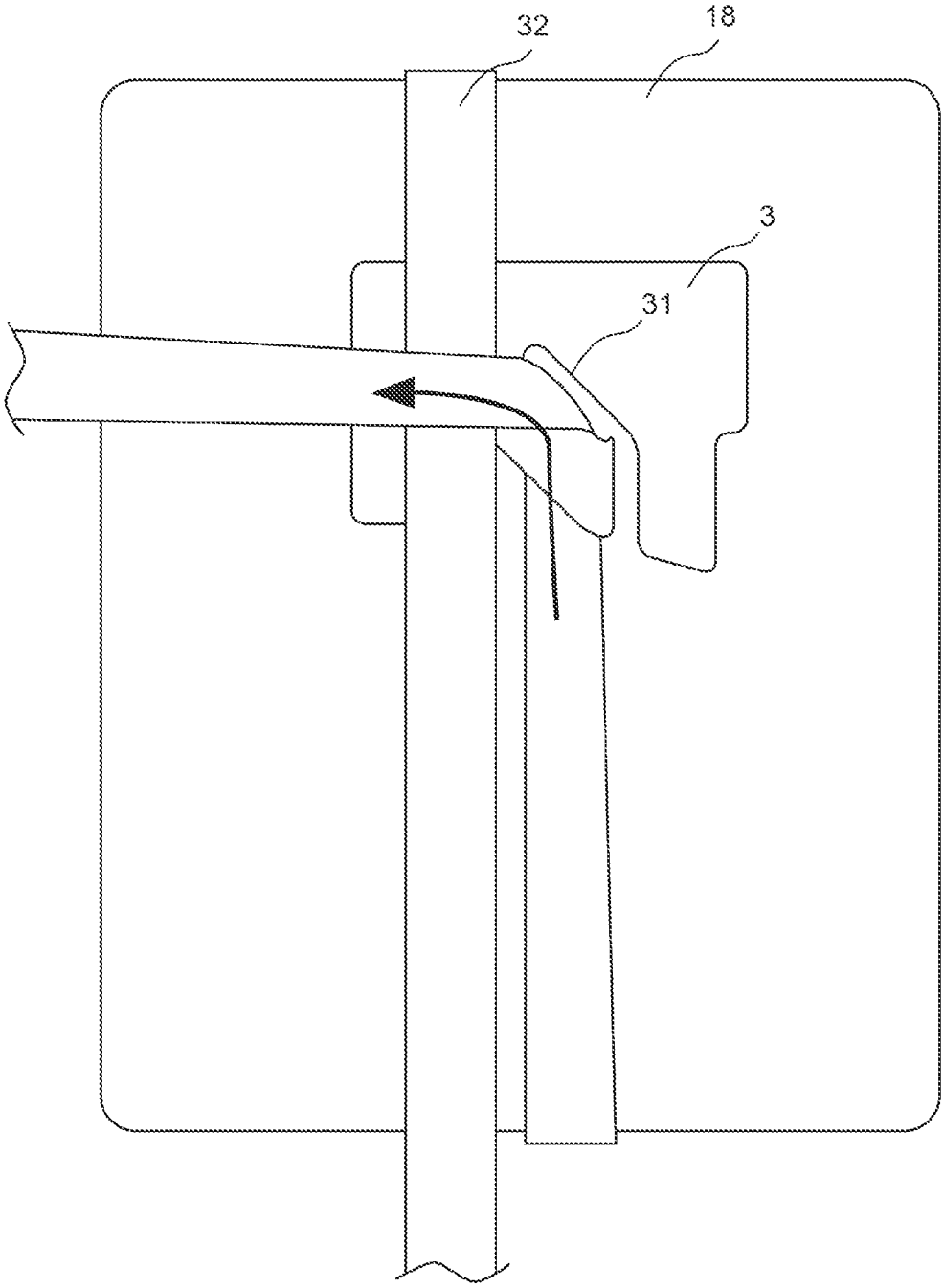
FIG. 20 is a schematic view showing the ribbon knot-tying process according to the one embodiment.

Next, as shown in FIG. 18, FIG. 19, place one end of a ribbon 32 at the bottom in front, take the rest of the ribbon upward and over to the rear side, and wrap it around once back to the bottom front of the object 18. Then, as shown in FIG. 20, the ribbon 32 wrapped around once is taken upward into the folding slit 31 of the ribbon-tying tool 3 and folded leftward to be redirected laterally.

Figure 21:
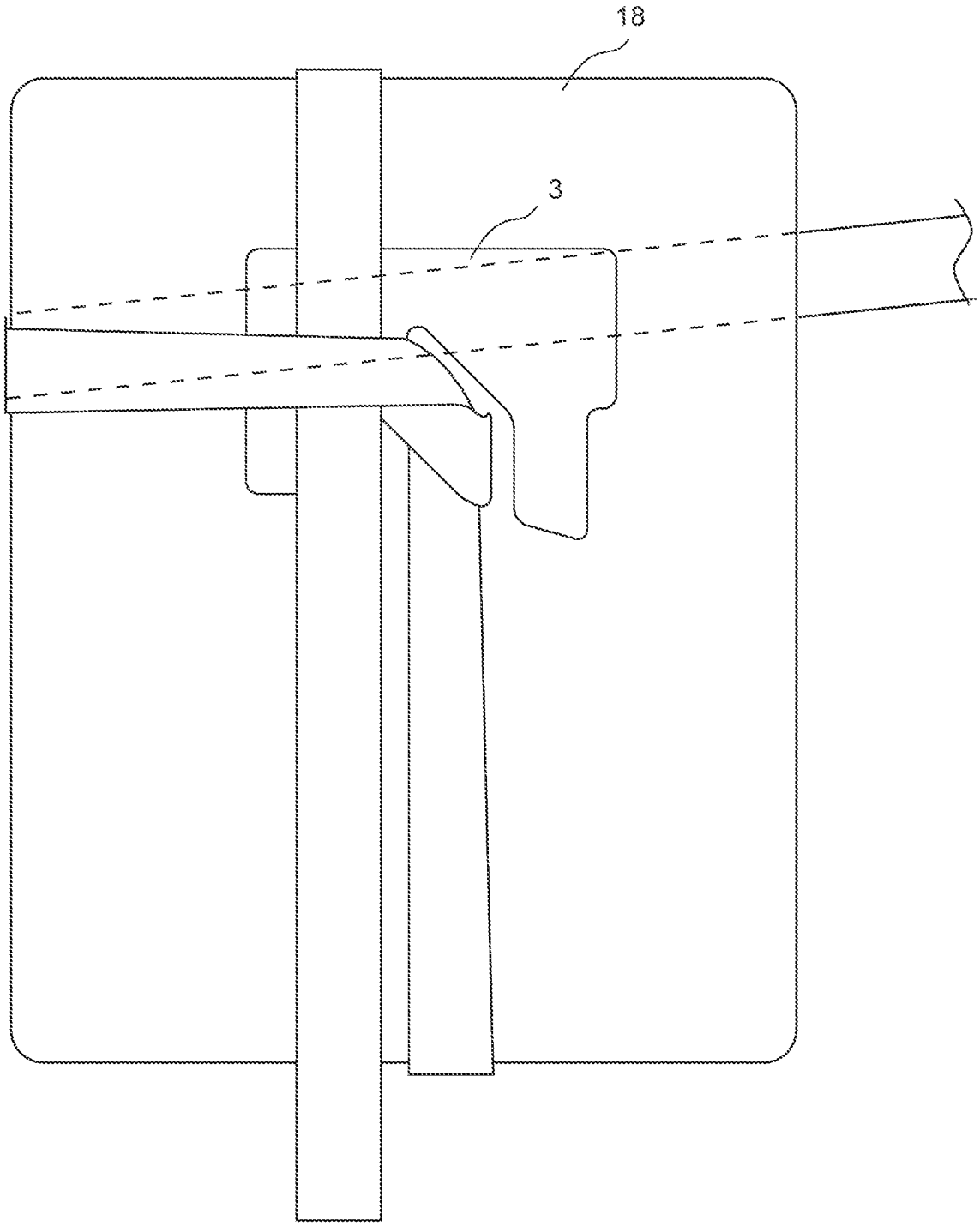
FIG. 21 is a schematic view showing the ribbon knot-tying process according to the one embodiment.
Figure 22:
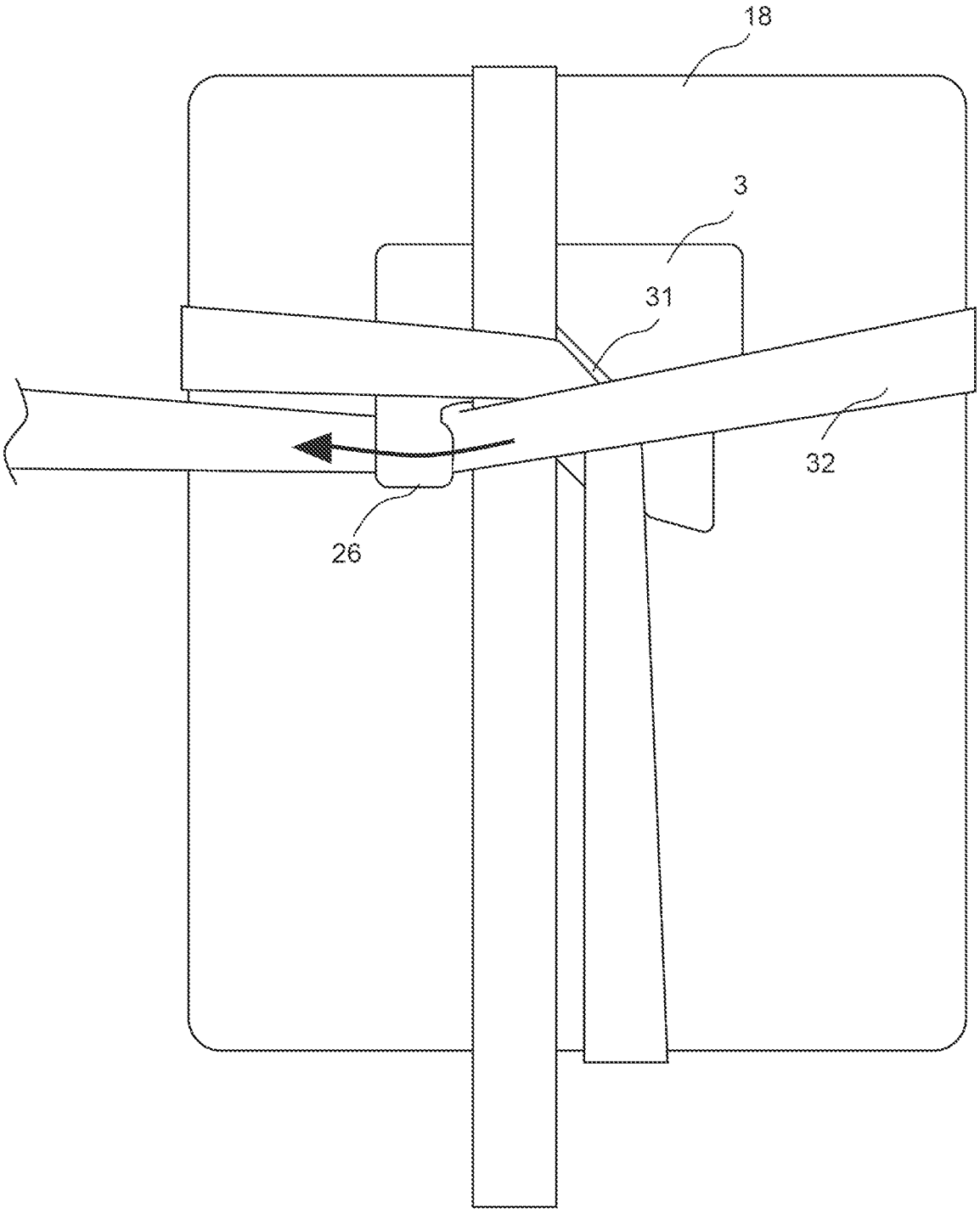
FIG. 22 is a schematic view showing the ribbon knot-tying process according to the one embodiment.

Subsequently, as shown in FIG. 21, the redirected ribbon 32 is wrapped around once from behind the object, and then, as shown in FIG. 22, passed under the ribbon pressing section 26, lifted upward somewhat to be hooked by the part indicated with an arrow in the figure.

Figure 23:
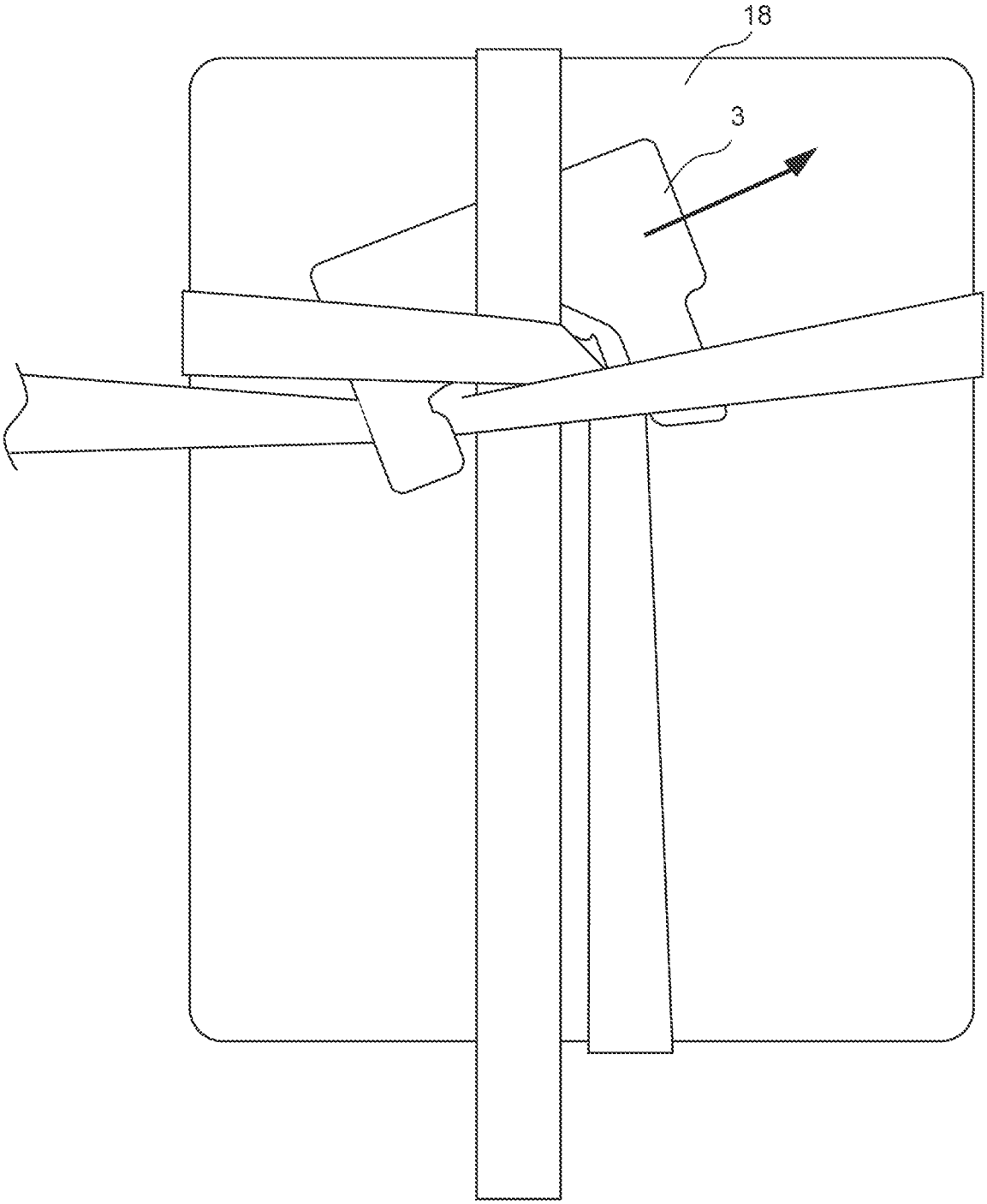
FIG. 23 is a schematic view showing the ribbon knot-tying process according to the one embodiment.
Figure 24:
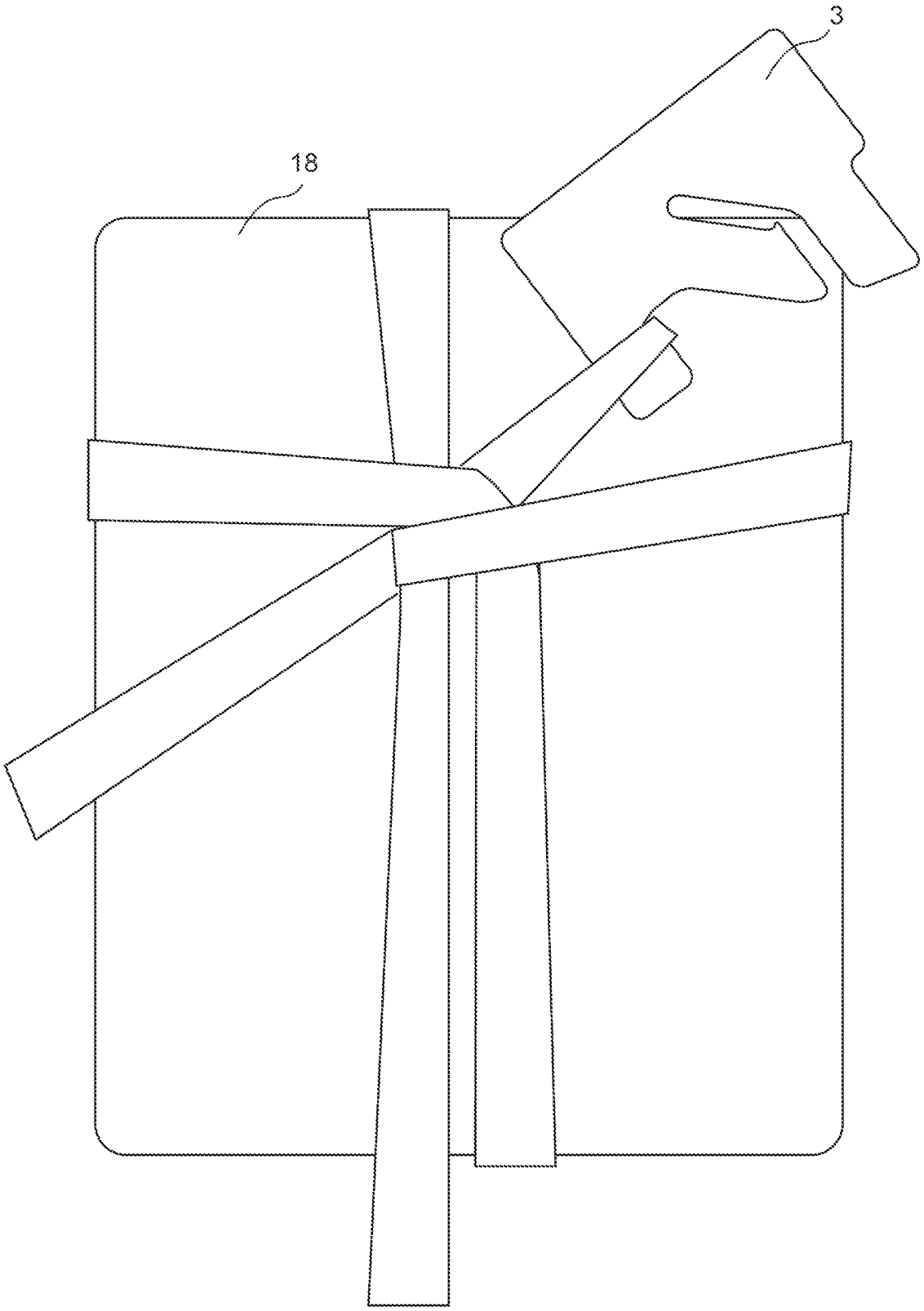
FIG. 24 is a schematic view showing the ribbon knot-tying process according to the one embodiment.
Figure 25:
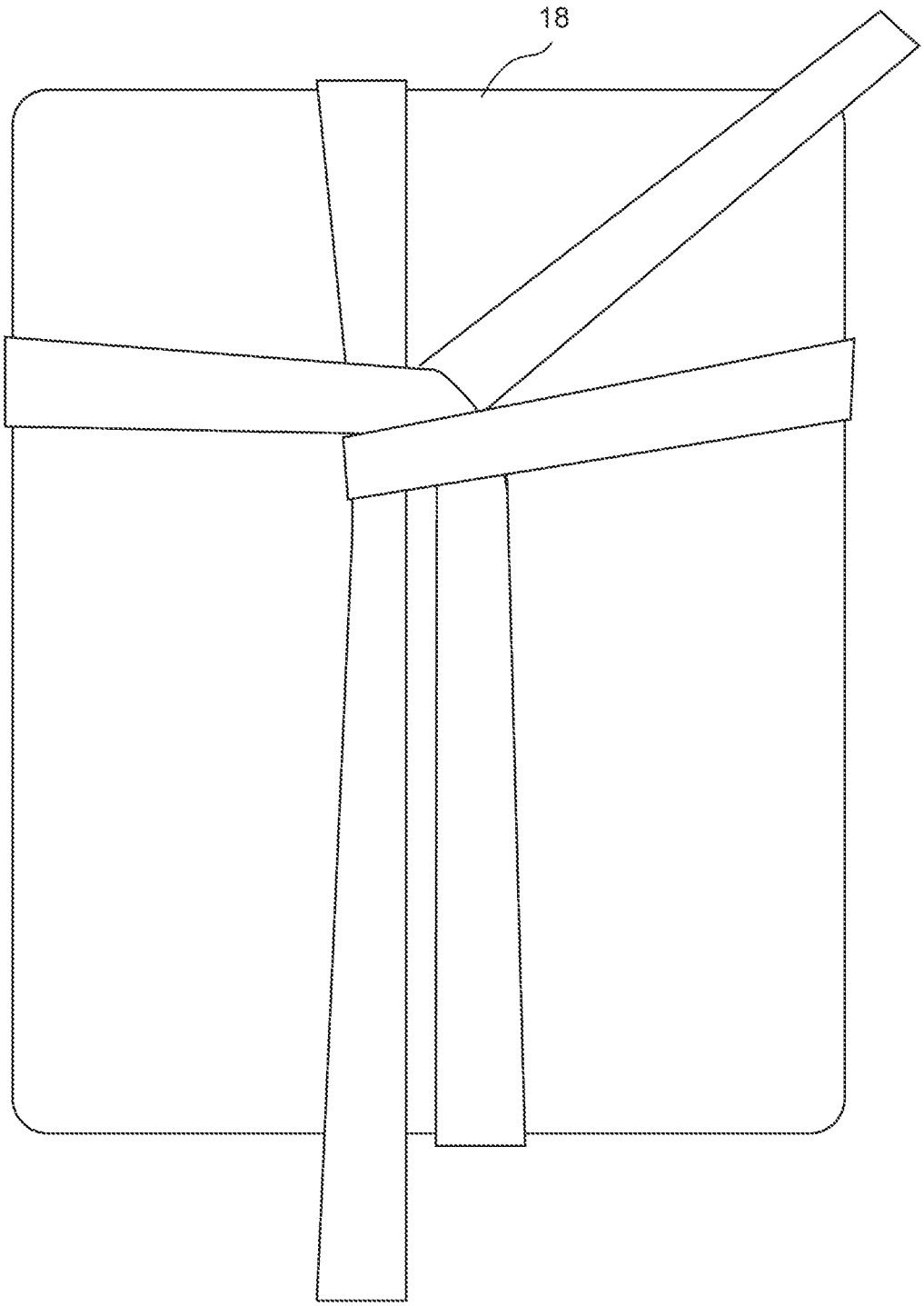
FIG. 25 is a schematic view showing the ribbon knot-tying process according to the one embodiment.
Figure 26:
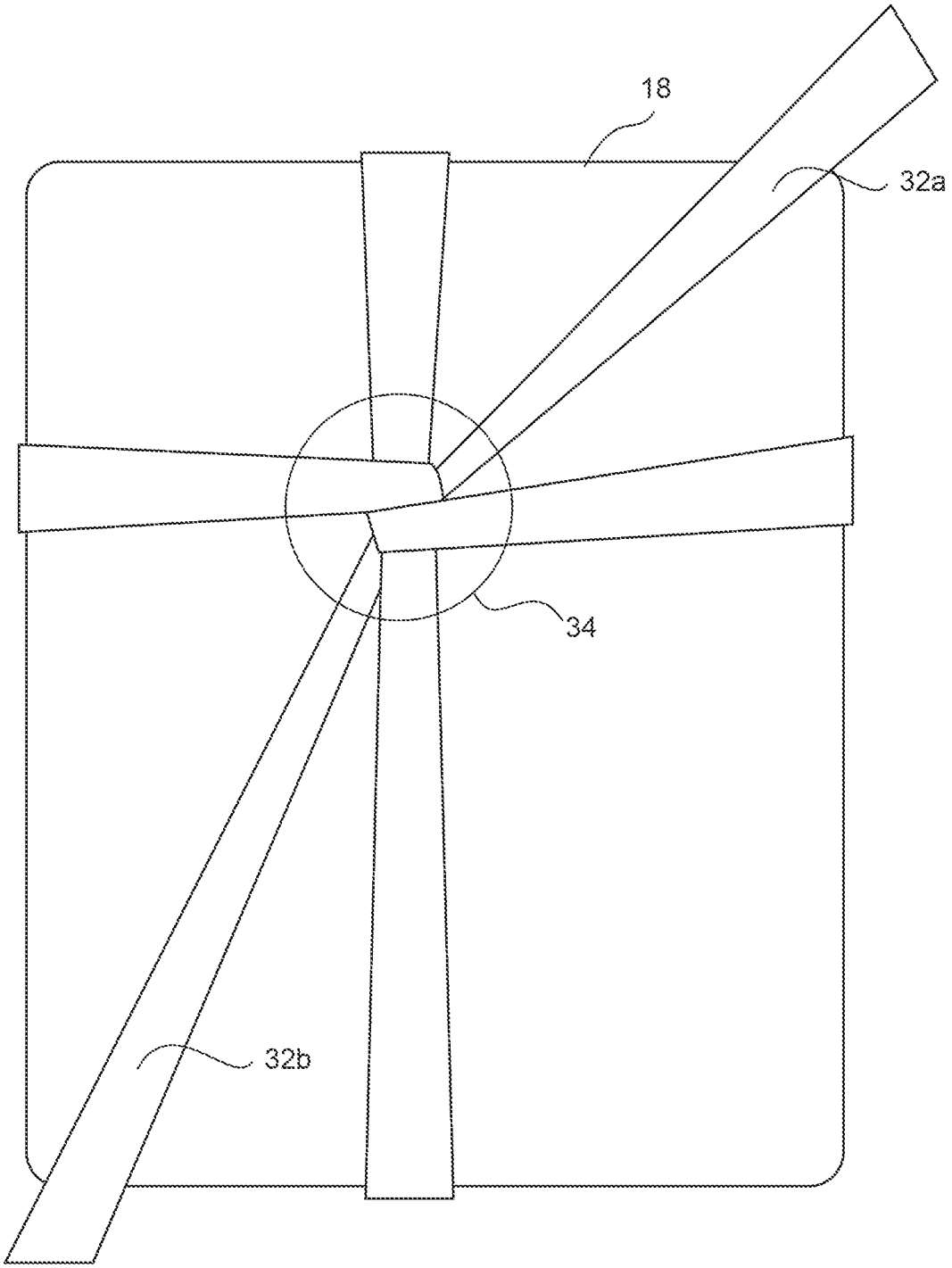
FIG. 26 is a schematic view showing the ribbon knot-tying process according to the one embodiment.
Figure 27:
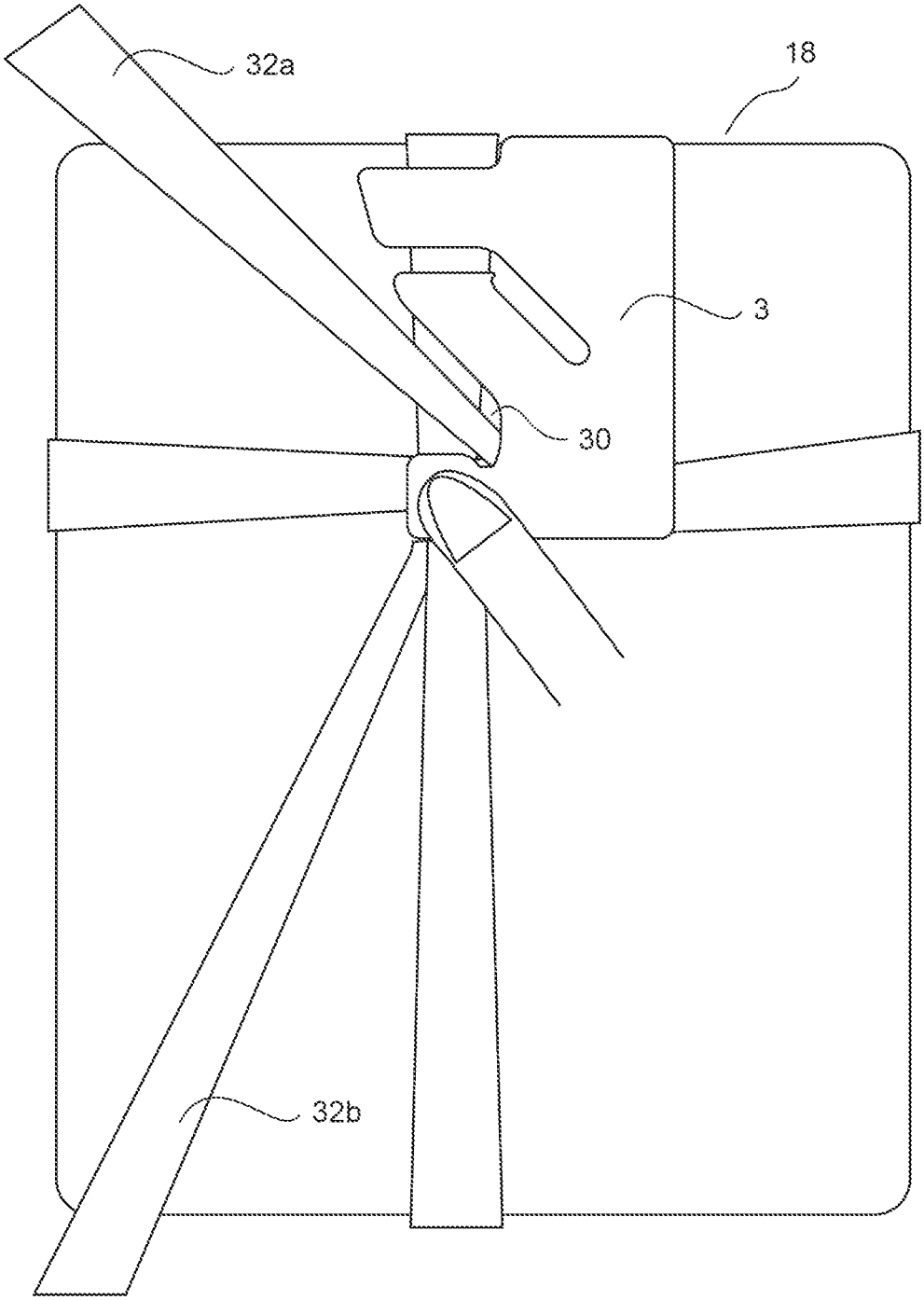
FIG. 27 is a schematic view showing the ribbon knot-tying process according to the one embodiment.

Next, after removing the ribbon 32 from the folding section 31, the ribbon-tying tool 3 is lifted right-upward while the ribbon is still hooked by the pressing section 26, as shown in FIG. 23, FIG. 24. Then, after the ribbon 32 hooked by the pressing section 26 is completely pulled out (FIG. 25), ends 32*a*, 32*b* of the ribbon 32 are pulled strongly in opposite directions to thereby create a criss-cross intersecting part 34, as shown in FIG. 26.

(2) Forming a Bowknot

Next, after the ribbon-tying tool 3 is turned over, the pressing section 26 is placed over the criss-cross intersecting part and pressed down by a finger. Then, the right-hand side ribbon end 32*a* is folded over to the left side so that it extends leftward exiting from under the space section 30 of the ribbon-tying tool 3, and the part where ribbon end 32*a* is folded is pressed down by the ribbon pressing section 3 as well.

Figure 28:
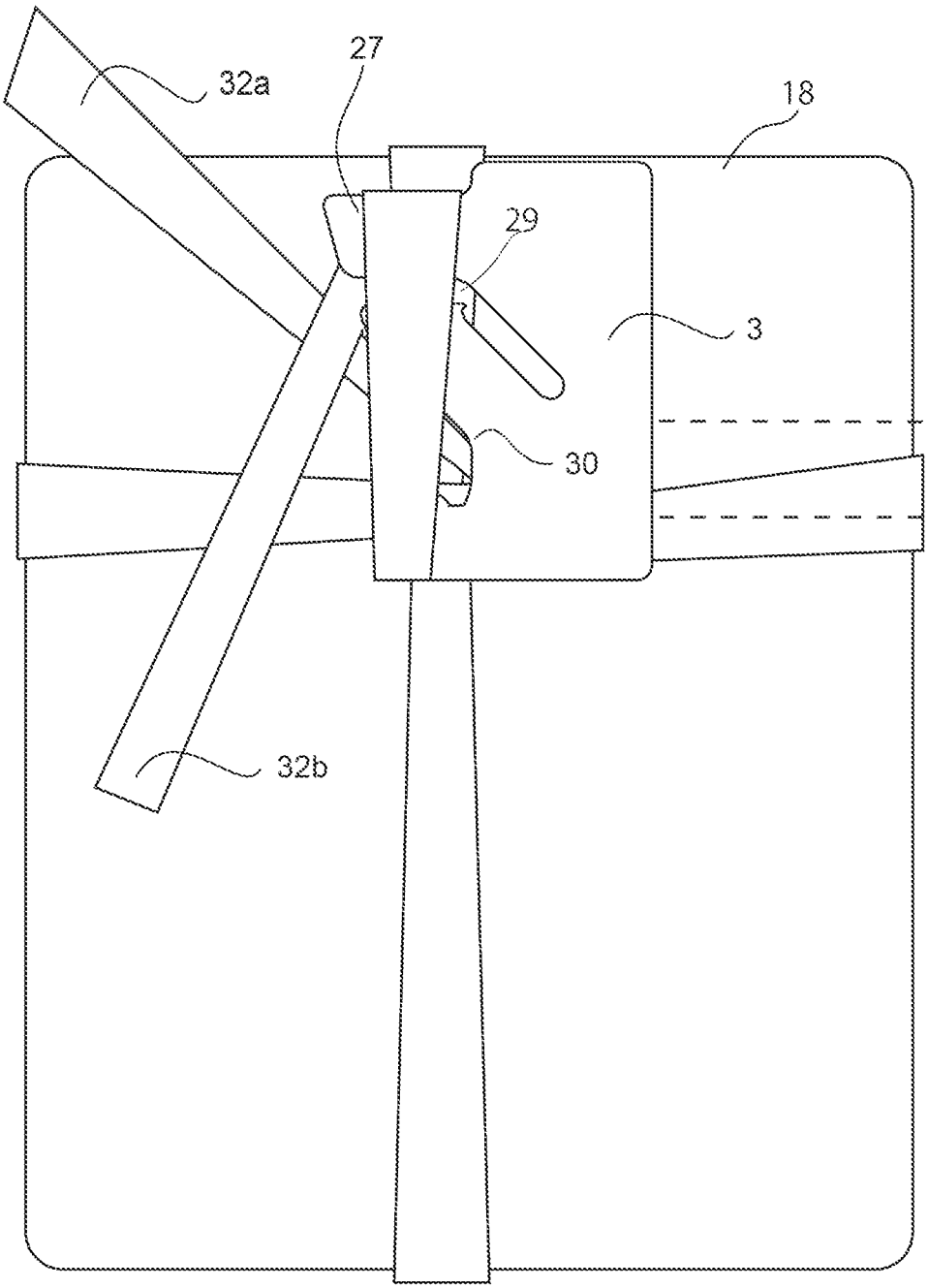
FIG. 28 is a schematic view showing the ribbon knot-tying process according to the one embodiment.
Figure 29:
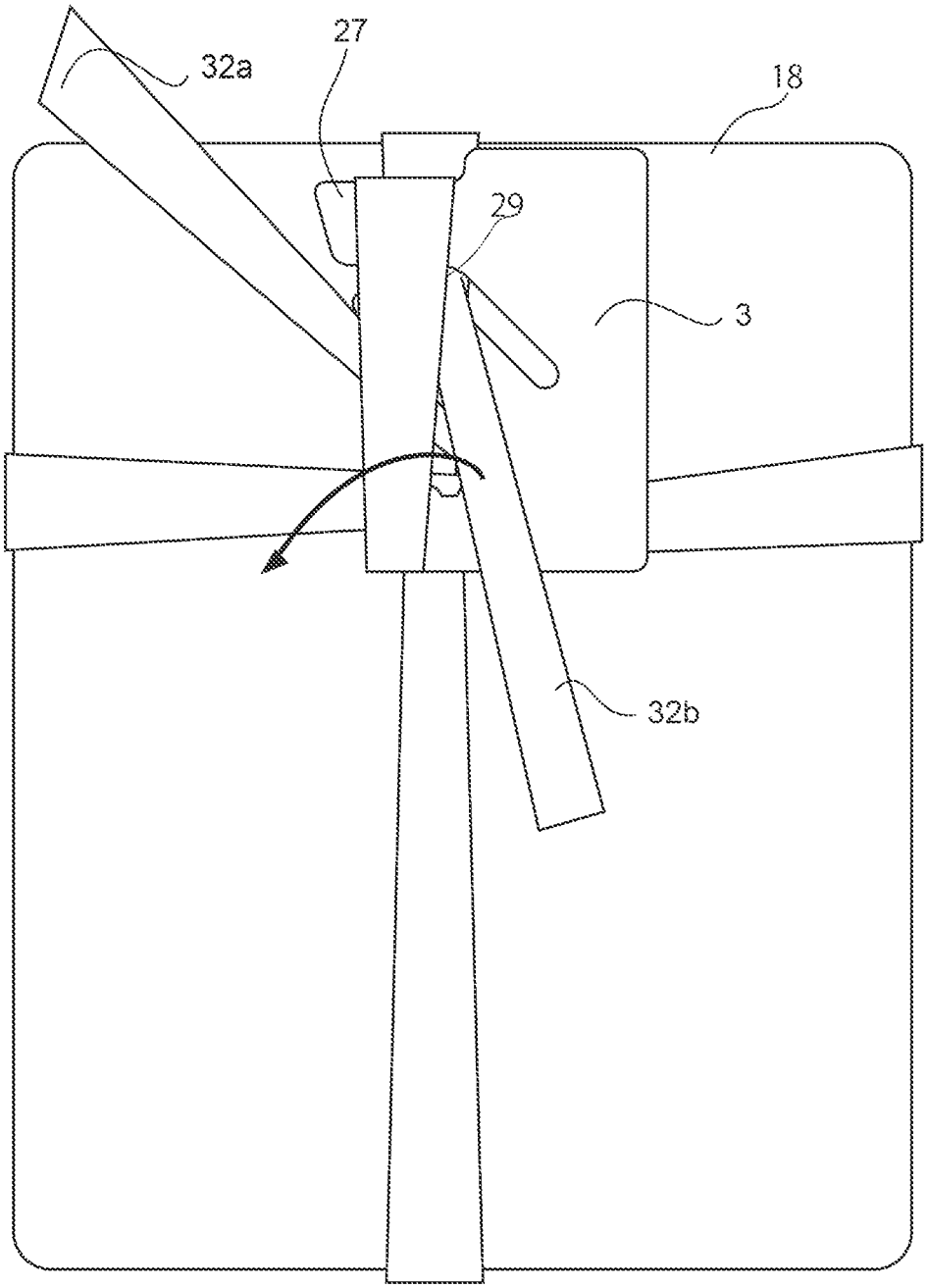
FIG. 29 is a schematic view showing the ribbon knot-tying process according to the one embodiment.

Next, as shown in FIG. 28, the left-hand side ribbon end 32*b* is lifted upward and looped by hand, and the loop is hooked over the first loop forming section 27. Then, as shown in FIG. 29, the folded-down part of the ribbon is moved rightward and pulled out of the slit 29 to extend downward on the right side.

Subsequently, the originally right-hand side ribbon 32*a*, which had been folded leftward, is folded rightward, looped, and passed through under the originally left-hand side ribbon 32*b*, which had been folded and looped vertically, as indicated with an arrow in the figure. The space section 30 is provided in order to facilitate this task.

Figure 30:
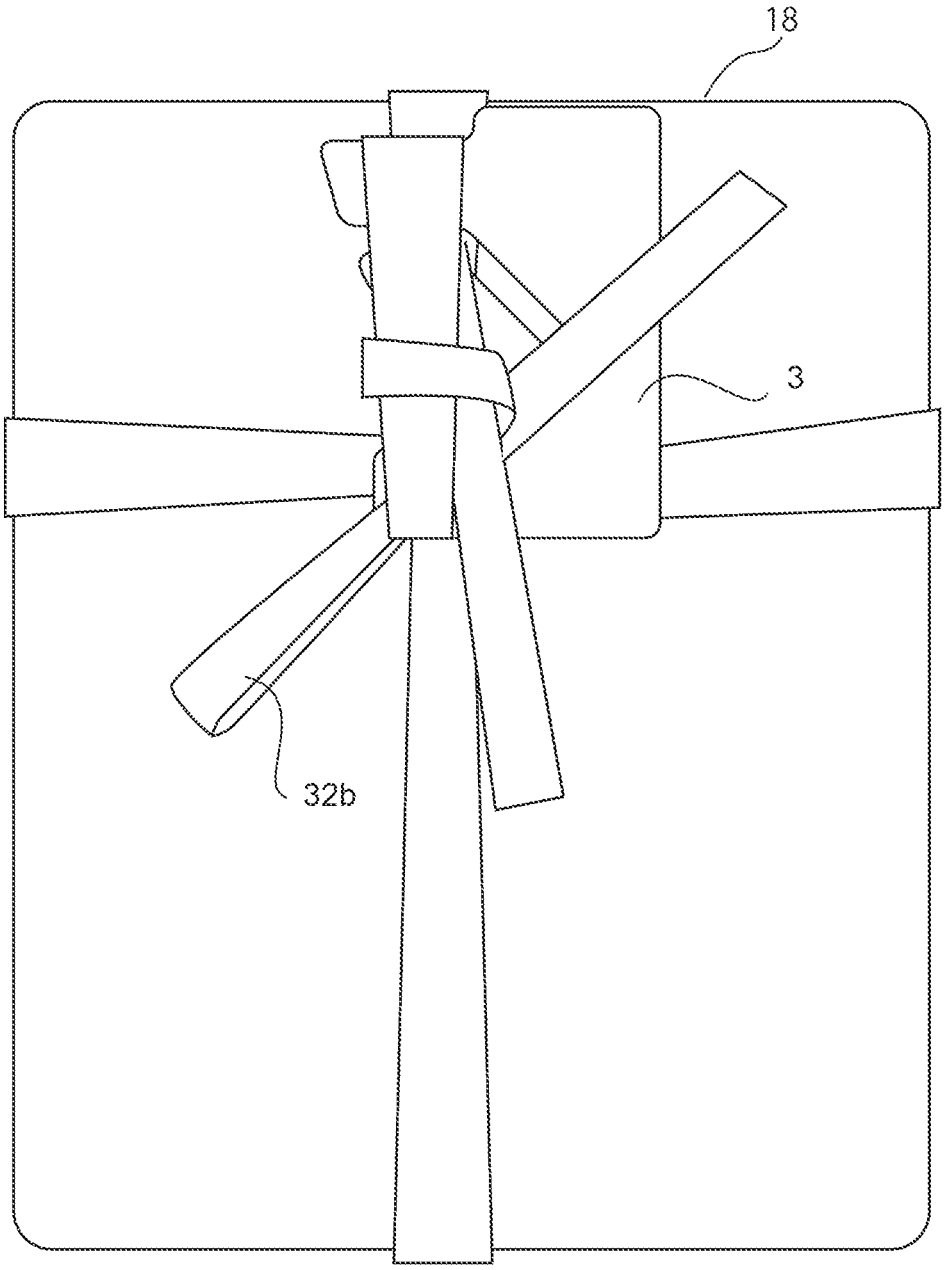
FIG. 30 is a schematic view showing the ribbon knot-tying process according to the one embodiment.
Figure 31:
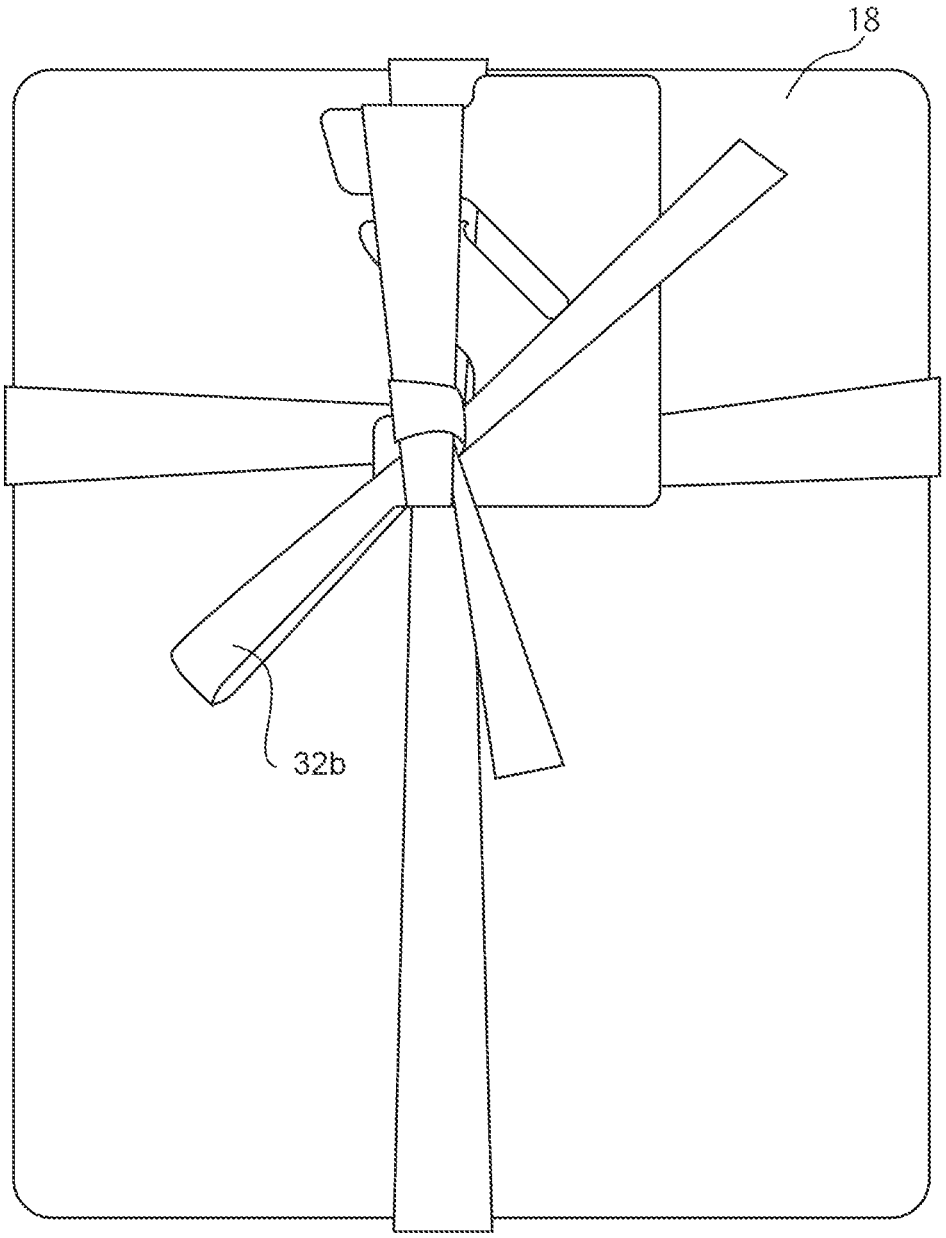
FIG. 31 is a schematic view showing the ribbon knot-tying process according to the one embodiment.

Thus, the second loop is formed of the left-hand side ribbon end 32*b*, as shown in FIG. 30, and further, pulling down the second loop creates a knot around the pressing section 26, as shown in FIG. 31.

Figure 32:
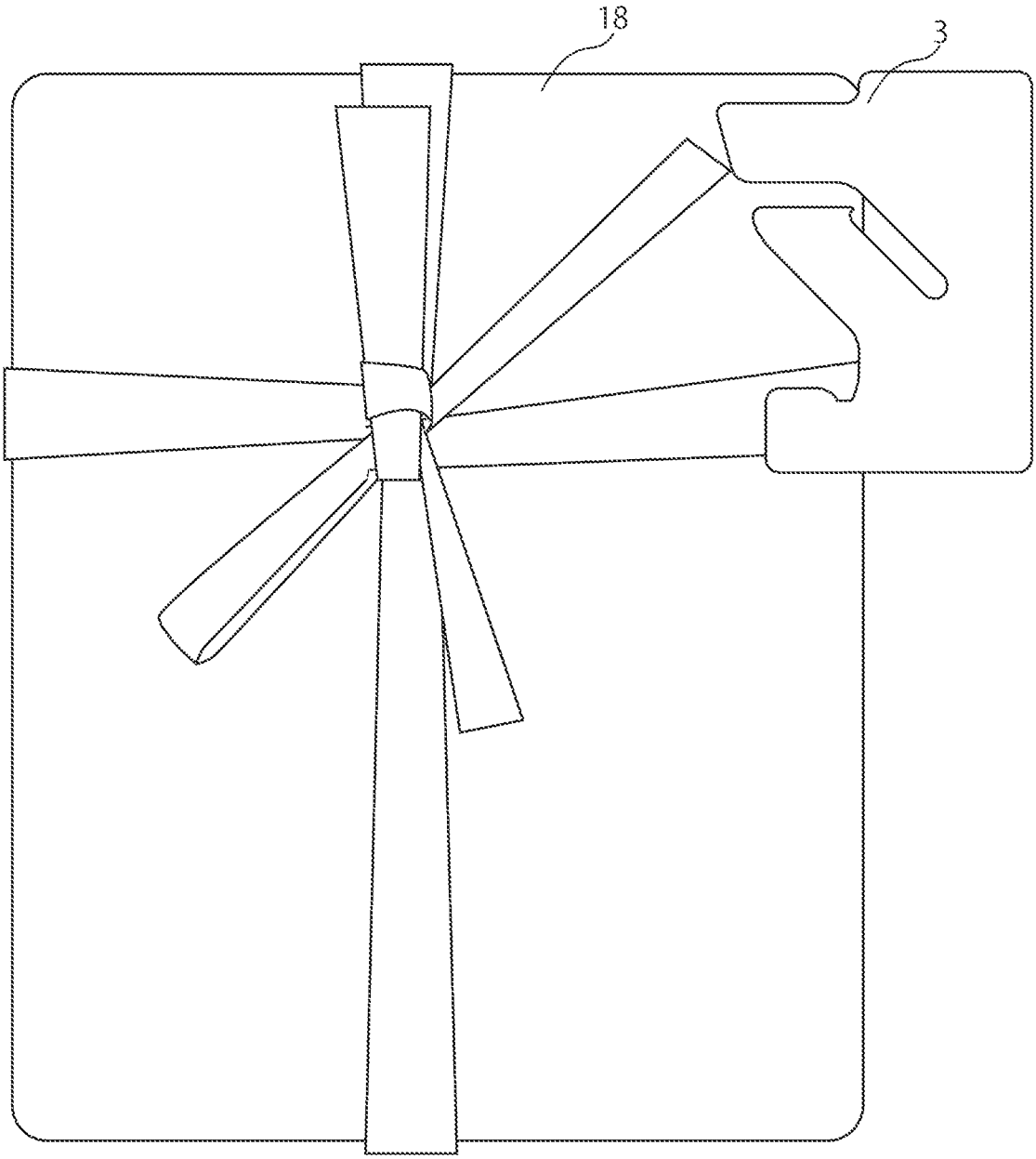
FIG. 32 is a schematic view showing the ribbon knot-tying process according to the one embodiment.
Figure 33:
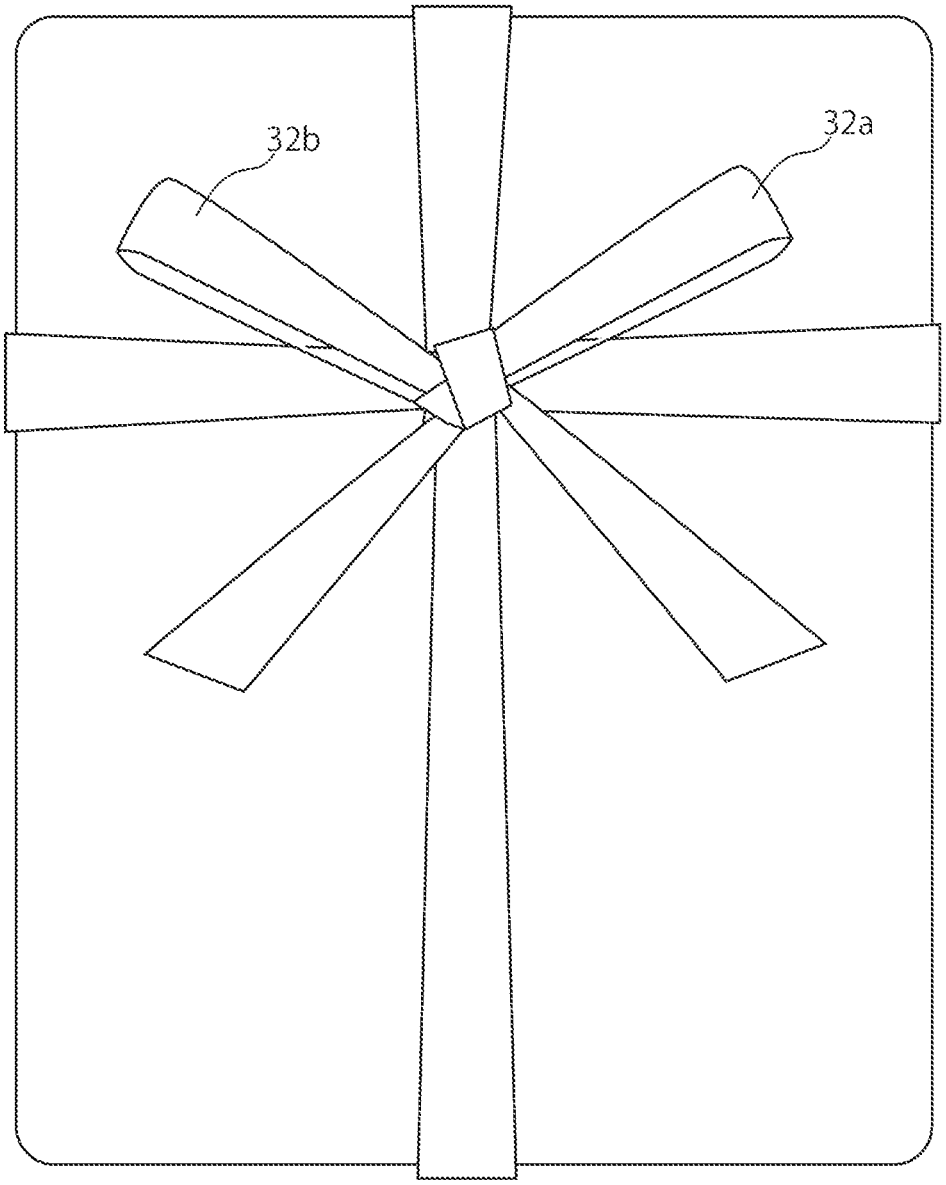
FIG. 33 is a schematic view showing the ribbon knot-tying process according to the one embodiment.

Next, the ribbon-tying tool 3 is removed from the knot, as shown in FIG. 32, and a bowknot is completed by more strongly tying and adjust the bow shape.

Although the optimal embodiment of the present invention has been described, it should be understood that the present invention is not be limited to the above embodiment, and various changes and modifications may be made without departing from the scope and spirit of the invention.

For example, in the above one embodiment, the first and second hinge sections were provided by mechanical processing such as pressing, laser milling, cutting, or the like, but they may be formed through a chemical processing such as etching.

Also, the hinge shaping method is not limited to processing, and for example, the hinges may be formed by preparing a PP sheet of generally the same size as the main body and of 0.2 mm thickness, and affixing rectangular PP sheets of 0.5 mm thickness to parts other than the hinge areas on an upper side or both sides of the first larger PP sheet. In this case, the panels constituting parts other than the hinges may be affixed to both sides of the hinge material.

Moreover, the above creasing tool was for the diagonal wrapping, but the present invention is not limited to the diagonal wrapping, and may be used for the caramel wrapping as well, in which case, the reference line may be provided at a different position.

Note that, in this embodiment, the object is assumed to be hexahedron-shaped and therefore, the hinges bend to 90 degrees, but when the object shape is other than hexahedron, hinge angles may be configured according to angles that the object sides create.

Also, the knot-tying tool is not limited to the above-described embodiment, and various changes and modifications may be made without departing from the spirit and scope of the present invention.

DESCRIPTION OF THE REFERENCE NUMBERS

1. Case
1*a*-1*c*. Recesses
2*a*. First panel
2*b*. Second panel
2*c*. Third panel
2*d*. Fourth panel
2*e*. Fifth panel
4. Cutting ruler
9. Thin plate main body
10. First hinge
11. Second hinge
12. Intersection
13. Third hinge
15. Reference line
17. Packaging paper
17*a*. Edge
17*b*. Edge
18. Object
19. Server
20. User interface
21. Packaging paper size calculation program
25. Main body
26. Intersection pressing section
27. First loop forming section
28. Second loop forming section
29. Slit
30. Space section
31. Slit
32. Ribbon
32*a*. Ribbon end
32*b*. Ribbon end
34. Intersecting part

The invention claimed is:

1. A creasing tool, comprising:

a thin plate-like main body having one surface and the other surface, wherein a sheet to be creased can be placed on the one surface;

a first hinge provided within the main body in a first direction, extending along the one surface and the other surface of the main body, for making a first crease on the sheet placed on the one surface by folding the main body along the first hinge;

a second hinge provided within the main body in a second direction intersecting the first hinge and extending along the one surface and the other surface of the main body, for making a second crease intersecting the first crease on the sheet placed on the one surface by folding the main body along the second hinge; and a third hinge provided within the main body in a third direction from the intersection of the first hinge and the second hinge and extending toward the outside of the main body along the bisection line of the angle formed between the first hinge and the second hinge, for making a third crease on the sheet placed on the one surface, extending from the intersection of the first and second hinges toward the outside of the main body by folding the main body along the third hinge.

2. The creasing tool of claim 1, wherein

"an" the angle between the first hinge and the second hinge is 90 degrees.

3. The creasing tool of claim 2, wherein the creasing tool is for diagonal wrapping using the sheet placed on the one surface of the main body, and a reference line is provided on the one surface of the main body to align an edge of the sheet with the reference line for positioning of the sheet relative to the main body.

4. The creasing tool of claim 3, wherein the reference line is drawn at an angle of about 33 degrees from the first hinge or the second hinge.

5. A method for wrapping an object with a wrapping paper using a creasing tool, the object having a shape with at least three surfaces meeting at one corner, the creasing tool comprising:

a thin plate-like main body having one surface and the other surface;

a first hinge provided within the main body in a first direction, extending along the one surface and the other surface of the main body;

a second hinge provided within the main body in a second direction intersecting the first hinge and extending across both the one surface and the other surface of the main body; and a third hinge that extends within the main body in a third direction from the intersection of the first hinge and the second hinge and extending toward the outside of the main body along the bisection line of the angle formed between the first hinge and the second hinge, the method comprising the steps of:

placing one of the three surfaces of the object on the one surface of the main body such that the wrapping paper is sandwiched between one of the three surfaces of the object and the one surface of the main body;

adjusting a position of the main body relative to the wrapping paper on the one surface of the main body such that the intersection of the first and second hinges coincides with the one corner of the object; and folding the main body at the first, second and third hinges, to crease the sheet along the first, second and third hinges thereby wrapping the other two surfaces of the object with the wrapping paper.

6. The method of claim 5, wherein

"an" the angle between the first hinge and the second hinge is 90 degrees.

7. The method of claim 5, wherein the creasing tool is for diagonal wrapping, and a reference line is provided on the one surface of the main body, the method further comprising the step of:

aligning an edge of the sheet with the reference line for positioning of the sheet relative to the main body.

* * * * *